US007649314B2

(12) United States Patent
Park et al.

(10) Patent No.: US 7,649,314 B2
(45) Date of Patent: Jan. 19, 2010

(54) PLASMA DISPLAY PANEL

(75) Inventors: Jung-Hwan Park, Chunan-si (KR); Hyun-Chul Song, Chunan-si (KR); Seung-Heon Shin, Chunan-si (KR); Young-Cheul Kang, Chunan-si (KR); Jeong-Jun Kim, Chunan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 686 days.

(21) Appl. No.: 11/371,521

(22) Filed: Mar. 8, 2006

(65) Prior Publication Data

US 2006/0232517 A1 Oct. 19, 2006

(30) Foreign Application Priority Data

Apr. 13, 2005 (KR) ..... 10-2005-0030666

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS

| | | | | |
|---|---|---|---|---|
| 5,670,843 | A | 9/1997 | Matsuura | |
| 6,242,859 | B1 | 6/2001 | Betsui et al. | |
| 6,414,434 | B1 | 7/2002 | Nakano et al. | |
| 6,495,958 | B1 | 12/2002 | Moon | |
| 6,761,605 | B2 | 7/2004 | Kado et al. | |
| 6,809,476 | B2 | 10/2004 | Lee et al. | |
| 6,855,026 | B2 * | 2/2005 | Fujinaga et al. | 445/24 |
| 6,867,546 | B1 | 3/2005 | Zhang et al. | |

(Continued)

FOREIGN PATENT DOCUMENTS

EP 1 388 876 A1 2/2004

(Continued)

OTHER PUBLICATIONS

English machine translation of Detailed Description for JP 2004-103249.*

(Continued)

*Primary Examiner*—Nimeshkumar D. Patel
*Assistant Examiner*—Anne M Hines
(74) *Attorney, Agent, or Firm*—Christie, Parker & Hale, LLP

(57) ABSTRACT

A plasma display panel reduces a resonance space between a frit and dummy partition walls so as to suppress noise and smoothly supply and exhaust a discharge gas. The plasma display panel includes a front substrate and a rear substrate that face each other, address electrodes and display electrodes that are spaced apart from each other and each extend along directions intersecting each other between the front substrate and the rear substrate, and partition walls that form a display region while partitioning a plurality of discharge cells and form a non-display region along a periphery of the display region between the front substrate and the rear substrate. The non-display region includes a first dummy area in which dummy cells are partitioned by dummy partition walls extending from partition walls disposed in the display region, and a second dummy area in which dummy cells are partitioned by dummy partition walls spaced apart from the first dummy area.

50 Claims, 13 Drawing Sheets

U.S. PATENT DOCUMENTS

| | | | |
|---|---|---|---|
| 2004/0046505 | A1 | 3/2004 | Kawanishi |
| 2004/0056597 | A1 | 3/2004 | Ko et al. |
| 2004/0091672 | A1 | 5/2004 | Ahn et al. |
| 2004/0201351 | A1 | 10/2004 | Woo et al. |

FOREIGN PATENT DOCUMENTS

| | | | |
|---|---|---|---|
| JP | 2001-160360 | | 6/2001 |
| JP | 2001-236890 | | 8/2001 |
| JP | 2001-307643 | | 11/2001 |
| JP | 2004-103249 | A | 4/2004 |
| JP | 2004-103419 | A | 4/2004 |
| JP | 2004-158432 | | 6/2004 |
| KR | 2001-0075761 | | 8/2001 |
| KR | 10-2004-0026209 | | 3/2004 |
| KR | 10-2005-0011267 | | 1/2005 |
| WO | WO 02/084689 | A1 | 10/2002 |

OTHER PUBLICATIONS

Patent Abstracts of Japan, Publication No. 2001-236890, dated Aug. 31, 2001, in the name of Kazutoshi Morikawa et al.

Korean Patent Abstracts, Publication No. 1020010075761, dated Aug. 11, 2001, in the name of Seok Cheon Ha.

European Search Report dated Nov. 23, 2007, for corresponding European Patent application 06100258.0, indicating relevance of all U.S. references and EP 1 388 876, and JP 2001-160360 in this IDS.

Patent Abstracts of Japan, Publication No. 2001-160360, dated Jun. 12, 2001, in the name of Hiroshi Saito et al.

Patent Abstracts of Japan, Publication No. 2001-307643, dated Nov. 2, 2001, in the name of Eitaro Yoshikawa et al.

Korean Patent Abstracts, Publication No. 1020040026209 A, dated Mar. 30, 2004, in the name of Eun Gi Huh et al.

Korean Patent Abstracts for Publication No. 1020050011267 A; Date of Publication of Application Jan. 29, 2005 in the name of Seok Gyun Woo.

Chinese Office action dated Apr. 17, 2009, for corresponding Chinese application 200510133984.1, noting U.S. reference previously filed in an IDS dated Feb. 12, 2008.

* cited by examiner

PLASMA DISPLAY PANEL

CROSS-REFERENCE TO RELATED APPLICATION

This application claims priority to and the benefit of Korean Patent Application No. 10-2005-0030666, filed in the Korean Intellectual Property Office on Apr. 13, 2005, the entire content of which is incorporated herein by reference.

BACKGROUND OF THE INVENTION

1. Field of the Invention

The present invention relates to a plasma display panel, and more particularly, to a plasma display panel that can improve the structure of dummy partition walls disposed in a non-display region, prevent looseness of an outer end by providing a frit having a large width, and supply and exhaust a discharge gas while reducing noise.

2. Description of the Related Art

Generally, a plasma display panel (PDP) is a device in which vacuum ultraviolet rays emitted through gas discharge generated in discharge cells excite phosphors to realize images. The plasma display panel is a next-generation thin display device because it can have a high resolution and a large screen.

In the plasma display panel, a discharge cell is partitioned by partition walls formed in a stripe-shaped or lattice-shaped pattern between a front substrate and a rear substrate. The partition walls are formed in the discharge cells constituting a display region that substantially realizes an image and a portion of a non-display region surrounding the display region, and provides dummy cells that stabilize discharge of outermost discharge cells of the display region. The partition walls forming such dummy cells are referred to as dummy partition walls.

The front substrate and the rear substrate are attached to each other by a frit interposed therebetween, and the frit is spaced apart from the dummy partition walls at a distance that can be significant enough to generate a resonance space, which causes noise of the panel.

If the frit having a large width is used in order to reduce the resonance space, the frit may enter an exhaust tube and contaminate the panel. On the other hand, if only the partition walls are expanded in order to reduce the resonance space, the partition walls may reduce the supply and exhaust of the discharge gas and thereby reduce the panel's luminance.

The above-described partition walls are made by forming a partition wall layer with partition wall paste; patterning the partition wall layer using a sandblast method, a press method, and an etching method using photosensitive materials; and firing the patterned partition walls at a high temperature of more than 450° C. The partition walls are fired in order to remove impurities, binders, and the like contained in a partition wall material, and make the partition walls harder.

When firing the partition walls, all vehicle components existing in the partition wall paste are evaporated, and main components constituting the partition walls are contracted by coupling with one another.

In this case, if the lattice structure of the partition walls of the plasma display panel is rectangular, as shown in FIG. 12, tension occurs along a longitudinal side of the partition walls 110 when the partition walls are fired, and thus the partition walls are bent (see portions indicated by circles).

Also, since the balance of force is not uniformly maintained at the outermost end of the partition walls, the partition wall is lifted inward when firing and thus looseness occurs.

Thus, the outermost end rises out of other portions. As a result, as shown in FIG. 13, a gap is generated between a front substrate 100 and the partition walls 110 (see a portion indicated by a circle). This gap causes noise due to a vibration when the panel is driven.

SUMMARY OF THE INVENTION

An embodiment of the present invention provides a plasma display panel in which a resonance space formed between a frit and dummy partition walls is reduced, thereby suppressing noise and allowing smooth supply and exhaust of a discharge gas.

Another embodiment of the present invention provides a plasma display panel that can suppress changes in shapes of partition walls so as to prevent the partition walls from being bent, thereby suppressing noise.

Another embodiment of the present invention provides a plasma display panel that can suppress changes in shapes of partition walls so as to improve uniformity of the heights of the partition walls and prevent a gap from being generated between the partition walls and a front substrate, thereby suppressing noise.

According to a first embodiment of the present invention, a plasma display panel includes a front substrate and a rear substrate that are disposed to face each other, address electrodes and display electrodes that are spaced from each other and each extend along directions intersecting each other between the front substrate and the rear substrate, and partition walls that form a display region while partitioning a plurality of discharge cells and form a non-display region along the periphery of the display region between the front substrate and the rear substrate. The non-display region includes dummy areas in which dummy cells are partitioned by dummy partition walls spaced apart from the display region at a plurality of intervals.

Each of the dummy areas includes a horizontal partition wall band formed in a band shape in parallel to one edge of the display region and a fan-shaped portion at both ends of the horizontal partition wall band, the fan-shaped portion being surrounded by an outer arc-shaped portion. The dummy areas may be provided on both sides of the display region along an extension direction of the address electrodes.

The horizontal partition wall band may include at least one horizontal partition wall member between an outermost horizontal partition wall member and an innermost horizontal partition wall member. In one embodiment, a distance between the outermost horizontal partition wall member and an adjacent horizontal partition wall member and a distance between the innermost horizontal partition wall member and an adjacent horizontal partition wall member may each be less than a distance between a pair of horizontal partition wall members located between the outermost horizontal partition wall member and the innermost horizontal partition wall member.

A line width of the outermost horizontal partition wall member may be wider than any other horizontal partition wall members.

The fan-shaped portion may include oblique partition wall members that linearly extend from a center of a line, which connects an end of the outermost horizontal partition wall member to an end of the innermost horizontal partition wall member, to the outer arc-shaped portion, respectively. In one embodiment, the oblique partition wall members may angularly quadrisect the fan-shaped portion. Also, the line which connects the front end of the outermost horizontal partition wall member with the front end of the innermost horizontal partition wall member may be shared by the horizontal partition wall band and the fan-shaped portion.

The outer arc-shaped portion may be connected to the outermost horizontal partition wall member of the horizontal partition wall band in the extension direction thereof, and the outermost horizontal partition wall member of the horizontal partition wall band may be formed in a linear shape. Further, the outer arc-shaped portion may be connected to the innermost horizontal partition wall member of the horizontal partition wall band in the extension direction thereof, and the innermost horizontal partition wall member of the horizontal partition wall band may be formed in a linear shape.

The outer arc-shaped portion may have a line width that is gradually widened from the innermost horizontal partition wall member to the outermost horizontal partition wall member of the horizontal partition wall band.

The fan-shaped portion may include arc-shaped partition wall members which respectively extend from one point of the horizontal partition wall band to another point thereof in an arc shape. In one embodiment, a distance between the outer arc-shaped portion of the fan-shaped portion and an adjacent arc-shaped partition wall member may be greater than a distance between the horizontal partition wall band and an adjacent arc-shaped partition wall member.

The fan-shaped portion may include rib partition wall members that linearly extend from the outer arc-shaped portion to at least one of the arc-shaped partition wall members and/or formed between adjacent ones of the arc-shaped partition wall members. In one embodiment, each of the rib partition wall members may divide each of the arc-shaped partition wall members at constant intervals. Each of the rib partition wall members may have a line width less than that of each of the arc-shaped partition wall members.

A line width of a frit for sealing the front substrate and the rear substrate may be greater than an interval between an inner surface of the frit and an outer surface of the dummy areas. In one embodiment, the line width of the frit is 2 to 3 times as larger as the interval between the inner surface of the frit and the outer surface of the dummy areas.

According to a second embodiment of the invention, a plasma display panel includes a first dummy area that is spaced apart from the display region and disposed in the non-display region, and a second dummy area that is spaced apart from the first dummy area and in which dummy cells are partitioned by dummy partition walls extending from partition walls disposed in the display region.

In one embodiment, the first dummy area may be formed similarly to the dummy area in the first embodiment of the invention described above. That is, the first dummy area includes a first horizontal partition wall band formed in a band shape in parallel to one edge of the display region, and a first fan-shaped portion surrounded by a first outer arc-shaped portion and on both sides of the first horizontal partition wall band.

The second dummy area includes a second fan-shaped portion that is disposed on an outside corner of the display region and is surrounded by a vertical line portion and a horizontal line portion intersecting each other and a second outer arc-shaped portion intersecting both line portions, a second horizontal partition wall band that comes in contact with the vertical line portion of the second fan-shaped portion, and a first vertical partition wall band that comes in contact with the horizontal line portion of the second fan-shaped portion.

An island partition wall member may be separately formed in a space between the first fan-shaped portion of the first dummy area and the second fan-shaped portion of the second dummy area so as to be spaced apart from the respective dummy areas. The island partition wall member may have a circular or ring-shaped section.

The second fan-shaped portion may include a second oblique partition wall member that linearly extends from an intersection of the vertical line portion and the horizontal line portion to the second outer arc-shaped portion. The second fan-shaped portion may include arc-shaped partition wall members that respectively extend from one point of the second horizontal partition wall band to another point thereof in an arc shape.

The second fan-shaped portion may include second rib partition wall members that linearly extend from the second outer arc-shaped portion to at least one of the arc-shaped partition wall members and/or are formed between adjacent ones of the arc-shaped partition wall members. Each of the arc-shaped partition wall members may be connected to a partition wall member of the second horizontal partition wall band and a partition wall member of the first vertical partition wall band in the extension direction thereof.

The vertical line portion and the horizontal line portion of the second fan-shaped portion may be shared by the second horizontal partition wall band and the first vertical partition wall band.

The second horizontal partition wall band may include at least one horizontal partition wall member between an outermost horizontal partition wall member and an innermost horizontal partition wall member. A distance between the outermost horizontal partition wall member and an adjacent horizontal partition wall member may be less than a distance between the innermost horizontal partition wall member and an adjacent horizontal partition wall member.

The first vertical partition wall band may include at least one vertical partition wall member between an outermost vertical partition wall member and an innermost vertical partition wall member. A distance between the outermost vertical partition wall member and an adjacent vertical partition wall member may be larger than a distance between the innermost vertical partition wall member and an adjacent vertical partition wall member.

The second outer arc-shaped portion may be connected to an outermost horizontal partition wall member of the second horizontal partition wall band in an extension direction thereof, and the second outer arc-shaped portion may be connected to an outermost vertical partition wall member of the first vertical partition wall band in an extension direction thereof.

According to a third embodiment of the invention, a plasma display panel includes a third dummy area in which dummy cells are partitioned by dummy partition walls extending from the second dummy area in an extension direction of a plurality of display electrodes and in the non-display region.

The third dummy area may be provided on both sides of the second dummy area in the extension direction of the plurality of display electrodes. Each third dummy area may include a third fan-shaped portion that is disposed on an inside corner of the display region and surrounded by a vertical line portion and a horizontal line portion intersecting each other and a third outer arc-shaped portion intersecting both line portions, and a second vertical partition wall band that comes in contact with the horizontal line portion of the third fan-shaped portion.

The third dummy area may further include a third vertical partition wall band that comes in contact with the vertical line portion of the third fan-shaped portion and the second vertical partition wall band connected thereto and is connected to the second dummy area.

The third fan-shaped portion may include at least one third oblique partition wall member that linearly extends from an intersection of the vertical line portion and the horizontal line portion to the third outer arc-shaped portion, and arc-shaped partition wall members that respectively extend from one point of the vertical line portion to one point of the horizontal line portion. Further, the third fan-shaped portion may include rib partition wall members that linearly extend from the third outer arc-shaped portion to at least one of the arc-shaped partition wall members and/or are formed between adjacent ones of the arc-shaped partition wall members.

The third outer arc-shaped portion may be connected to an outermost horizontal partition wall member of the third vertical partition wall band in an extension direction thereof and the outermost horizontal partition wall member of the third vertical partition wall band may be formed in a linear shape. Further, the third arc-shaped portion may be connected to an outermost vertical partition wall member of the third vertical partition wall band in an extension direction thereof, and the outermost vertical partition wall member of the third vertical partition wall band may be formed in a linear shape.

BRIEF DESCRIPTION OF THE DRAWINGS

The accompanying drawings, together with the specification, illustrate exemplary embodiments of the present invention and together with the description serve to explain the principles of the invention.

DETAILED DESCRIPTION

Figure 1:
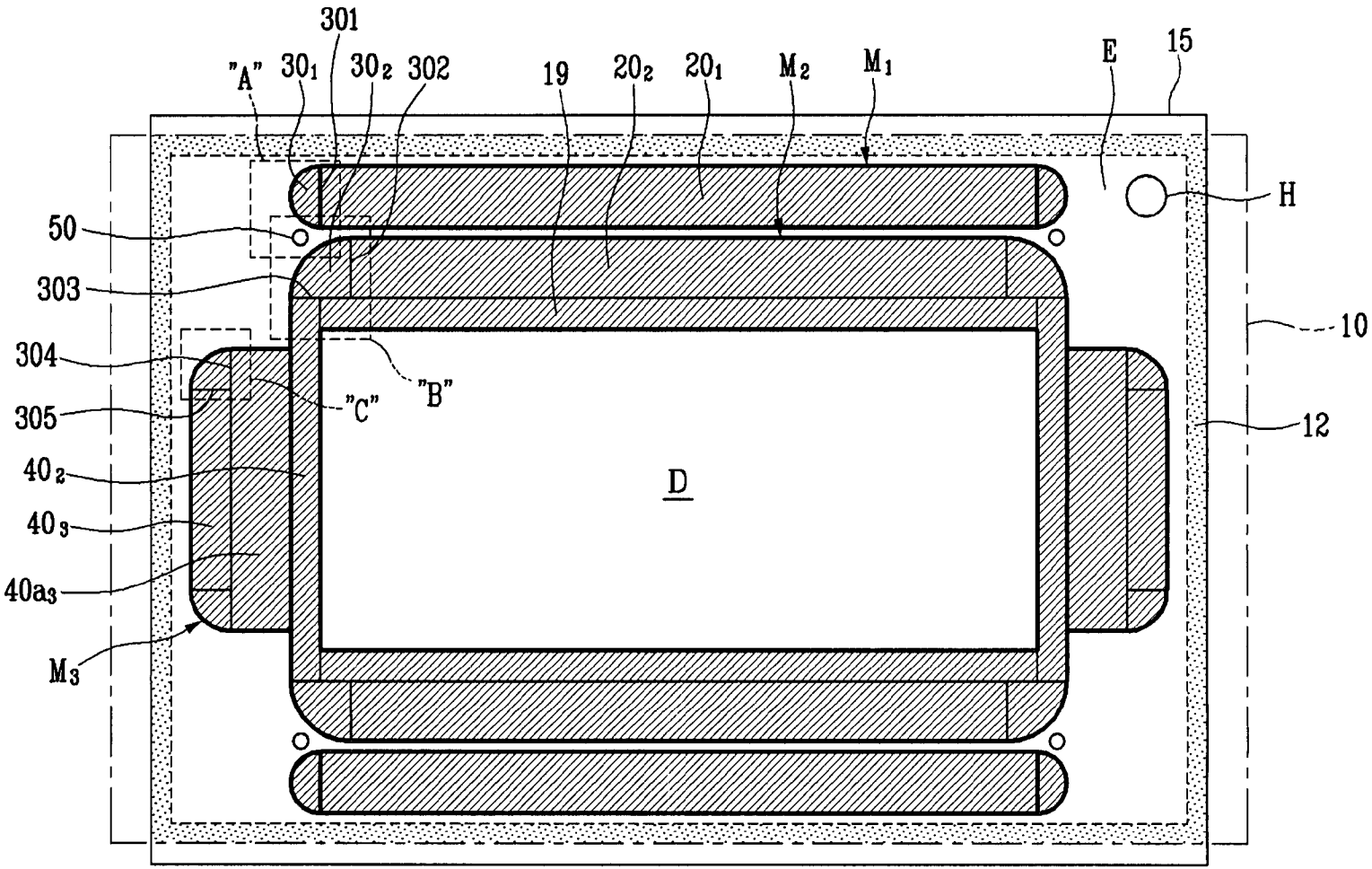
FIG. 1 is a plan view of a plasma display panel according to an embodiment of the present invention.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification as they are not essential to a complete understanding of the invention. Like reference numerals designate like elements.

Figure 2:
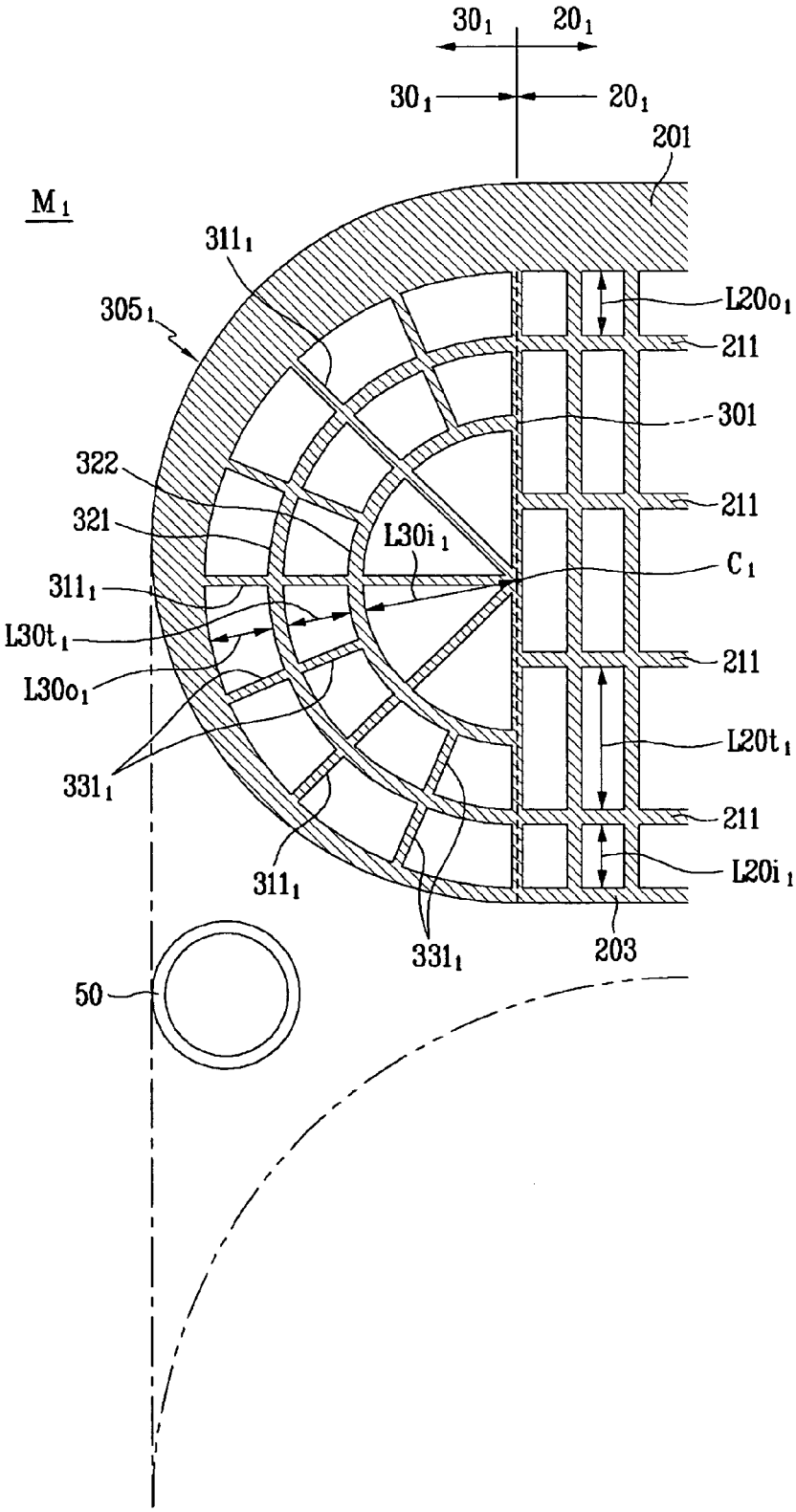
FIG. 2 is a partial plan view of a portion "A" shown in FIG. 1 in a magnified scale.

FIG. 1 is a plan view of a plasma display panel according to an embodiment of the present invention, and FIG. 2 is a partial plan view of a portion "A" shown in FIG. 1 in a magnified scale.

As shown in FIGS. 1 and 2, the plasma display panel according to the embodiment of the present invention has a structure in which a front substrate 10 and a rear substrate 15 are disposed to face each other with a predetermined gap that is sealed. The plasma display panel is divided into a display region D in which visible light is emitted to display an actual image and a non-display region that is disposed along the periphery of the display region D.

In the display region D, a plurality of discharge cells are partitioned by partition walls that are disposed between the front substrate 10 and the rear substrate 15. The non-display region is divided into a first dummy area $M_1$ in which first dummy cells are partitioned by first dummy partition walls spaced apart from the display region D, a second dummy area $M_2$ that is spaced from the first dummy area $M_1$ and in which second dummy cells are partitioned by second dummy partition walls extending from the partition walls disposed in the display region D, and a redundant area E that is disposed outside the first dummy area $M_1$ and the second dummy area $M_2$ so as to form a space up to a frit 12 for sealing the front substrate 10 and the rear substrate 15.

The first dummy area $M_1$ may be formed on four places corresponding to four sides of the second dummy area $M_2$ surrounding the display region D or may be formed on two sides along a vertical direction (FIG. 1) of the display region D, as shown in FIG. 1.

As also shown in FIG. 1, if the first dummy area $M_1$ is formed on the two sides of the display region D, the non-display region may further include a third dummy area $M_3$ on a side of the second dummy area $M_2$ where the first dummy area $M_1$ is not provided. The third dummy area $M_3$ has third dummy cells that are partitioned by third dummy partition walls extending from the second dummy area $M_2$ to two sides along a horizontal direction (FIG. 1).

Since the first dummy area $M_1$, the second dummy area $M_2$, and the third dummy area $M_3$ reduce a resonance space formed in the non-display region, noise occurring in the resonance space can be reduced. Further, the first dummy area $M_1$ is spaced apart from the display region D, the second dummy area $M_2$, and the third dummy area $M_3$, and supply and exhaust paths of discharge gas are formed between the dummy areas. With these additional dummy areas (e.g., the dummy areas $M_1$, $M_2$, and $M_3$), the supply and exhaust resistance of the discharge gas can be minimized and thus the discharge gas can be smoothly supplied and exhausted through an exhaust tube H.

The first dummy area $M_1$ is spaced apart from the display region D and includes a first horizontal partition wall band $\mathbf{20}_1$ in a band shape that is formed in parallel to one edge of the display region D and a first fan-shaped portion 30, that is surrounded by a first outer arc-shaped portion $\mathbf{305}_1$ see FIG. 2) and on both ends of the first horizontal partition wall band $\mathbf{20}_1$.

The first horizontal partition wall band $\mathbf{20}_1$ includes horizontal partition wall members that are formed in a direction parallel to the one edge of the display region D and vertical partition wall members that are formed in a direction to intersect the horizontal partition wall members, thereby forming a plurality of first dummy cells. At least one of the horizontal partition wall members may be formed between an outermost horizontal partition wall member 201 and an innermost horizontal partition wall member 203 of the first horizontal partition wall band $\mathbf{20}_1$. In the present embodiment, four horizontal partition wall members are formed therebetween.

In this case, a distance L20*o*, between the outermost horizontal partition wall member 201 and an adjacent horizontal partition wall member 211 and a distance $L\mathbf{20}i_1$ between the innermost horizontal partition wall member 203 and an adjacent horizontal partition wall member 211 are less than a distance $L\mathbf{20}t_1$ between two adjacent ones of the horizontal partition wall members 211 that are disposed between the outermost horizontal partition wall member 201 and the innermost horizontal partition wall member 203. In the present embodiment, the distance $L\mathbf{20}o_1$ and the distance $L\mathbf{20}i_1$ have the same value, which is a half of the distance $L\mathbf{20}t_1$.

Also, as regards to the partition wall members disposed inside the first horizontal partition wall band $\mathbf{20}_1$ a constant force acts in four directions, so that bending does not occur. However, the balance of force may be upset at an end, such as the outermost horizontal partition wall member 201. Accordingly, looseness at a bottom surface of the outermost horizontal partition wall member 201 may occur that is caused by a removal of the outermost horizontal partition wall member 201 from a dielectric layer. In order to prevent this problem, the outermost horizontal partition wall member 201 is maintained from an adjacent horizontal partition wall member 211 at a short distance $L\mathbf{20}o_1$ by vertical partition wall members so as to efficiently cope with attractive forces that occur when firing. Further, the outermost horizontal partition wall member 201 has a line width larger than that of other horizontal partition wall members 211, such that the partition wall can be efficiently prevented from being damaged when the partition wall layer is etched by a sandblast method. Here, the line width of each of the partition wall members can be defined as the width between an upper end and a lower end with respect to a longitudinal direction of the respective partition wall member.

The first fan-shaped portion 30, is surrounded by the first outer arc-shaped portion $\mathbf{305}_1$ from a center $C_1$ of a line 301, which extends from a front (or lower) end of the outermost horizontal partition wall member 201 to a front (or lower) end of the innermost horizontal partition wall member 203, to form a semicircle region. The first horizontal partition wall band $\mathbf{20}_1$ comes in contact with the line 301. In the present embodiment, the first outer arc-shaped portion $\mathbf{305}_1$ of the first fan-shaped portion $\mathbf{30}_1$ may be formed such that the inner surface thereof is spaced apart from the center $C_1$ of the line 301 at a constant distance.

First oblique partition wall members $\mathbf{311}_1$ linearly extending from the center $C_1$ of the line 301 to the first outer arc-shaped portion $\mathbf{305}_1$ are formed in the first fan-shaped portion $\mathbf{30}_1$ of the first dummy area $M_1$. The number of the first oblique partition wall members $\mathbf{311}_1$ may be three such that the first fan-shaped portion $\mathbf{30}_1$ is angularly quadrisected. Accordingly, if the first fan-shaped portion $\mathbf{30}_1$ is formed in a semicircle shape, as shown in FIGS. 1 and 2, each of the quadrisected parts of the first fan-shaped portion $\mathbf{30}_1$ by the three first oblique partition wall members $\mathbf{311}_1$ has an angle that is about 45 degrees.

Arc-shaped partition wall members 321 and 322 which extend from one point of the first horizontal partition wall band $\mathbf{20}_1$ to another point thereof in an arc shape are formed in the first fan-shaped portion $\mathbf{30}_1$ of the first dummy area $M_1$. In the present embodiment, the two arc-shaped partition wall members 321 and 322 are disposed between the first outer arc-shaped portion $\mathbf{305}_1$ and the center $C_1$.

In addition, a distance $L\mathbf{30}o_1$ between the first outer arc-shaped portion $\mathbf{305}_1$ and adjacent arc-shaped partition wall member 321, a distance $L\mathbf{30}t_1$ between the arc-shaped partition wall members 321 and 322, and a distance $L\mathbf{30}i_1$ between the arc-shaped partition wall member 322 and the center $C_1$ may be different from one another. In the present embodiment, the distance $L\mathbf{30}i_1$ between the center $C_1$ and the adjacent arc-shaped partition wall member 322 is greater than the distance $L\mathbf{30}o_1$ between the first outer arc-shaped portion $\mathbf{305}_1$ and the adjacent arc-shaped partition wall member 321 and is also greater than the distance L30*t*, between the adjacent arc-shaped partition wall members 321 and 322. In FIG. 2, at least one of the arc-shaped partition wall members 321 and 322 (e.g., the wall member 321) is connected to at least one of the partition wall members 211 of the first horizontal partition wall band $\mathbf{20}_1$ in the extension direction thereof. The distance $L\mathbf{30}o_1$ and the distance $L\mathbf{30}t_1$ may be of substantially the same value.

Further, first rib partition wall members $\mathbf{331}_1$ that linearly extend from the first outer arc-shaped portion $\mathbf{305}_1$ to the arc-shaped partition wall members 321 and 322 are formed in the first fan-shaped portion $\mathbf{30}_1$ of the first dummy area $M_1$. Each of the first rib partition wall members $\mathbf{331}_1$ has a line width that is less than a line width of each of the first arc-shaped partition wall members 321 and 322.

The first rib partition wall members $\mathbf{331}_1$ may be formed so as to divide the arc-shaped partition wall members 321 and 322 at uniform intervals. The number of the first rib partition wall members $\mathbf{331}_1$ disposed between the first outer arc-shaped portion $\mathbf{305}_1$ and the adjacent arc-shaped partition wall member 321 may be greater than the number of the first rib partition wall members $\mathbf{331}_1$ disposed between the adjacent arc-shaped partition wall members 321 and 322.

In addition, the first horizontal partition wall band $\mathbf{20}_1$ and the first fan-shaped portion $\mathbf{30}_1$ share the line 301 that connects the front end of the outermost horizontal partition wall member 201 to the front end of the innermost horizontal partition wall member 203 in the first dummy area $M_1$. That is, the line 301 separates the first horizontal partition wall band $\mathbf{20}_1$ from the first fan-shaped portion $\mathbf{30}_1$.

The first outer arc-shaped portion $\mathbf{305}_1$ is connected to the outermost horizontal partition wall member 201 of the first horizontal partition wall band $\mathbf{20}_1$ in the extension direction thereof, and the outermost horizontal partition wall member 201 of the first horizontal partition wall band $\mathbf{20}_1$ is formed in a linear shape. Further, the first outer arc-shaped portion $\mathbf{305}_1$ is connected to the innermost horizontal partition wall member 203 of the first horizontal partition wall band $\mathbf{20}_1$ in the extension direction thereof, and the innermost horizontal partition wall member 203 of the first horizontal partition wall band $\mathbf{20}_1$ is formed in a linear shape. The outermost horizontal partition wall member 201 and the innermost horizontal partition wall member 230 are formed in linear shapes and thus serve as supports for preventing the ends of the partition walls from loosening.

The first outer arc-shaped portion $\mathbf{305}_1$ has a line width which is gradually widened from the innermost horizontal partition wall member 203 to the outermost horizontal partition wall member 201 of the first horizontal partition wall band $\mathbf{20}_1$. The front end at the outermost horizontal partition wall member 201 of the first outer arc-shaped portion $\mathbf{305}_1$ has a line width equal to that of the outermost horizontal partition wall member 201, and the front end at the innermost horizontal partition wall member 203 of the first outermost arc-shaped portion $\mathbf{305}_1$ has a line width equal to that of the innermost horizontal partition wall member 203.

Accordingly, the first outer arc-shaped portion $\mathbf{305}_1$ has a line width greater than that of each of the arc-shaped partition wall members 321 and 322, the first oblique partition wall members $\mathbf{311}_1$, and the first rib partition wall members $\mathbf{331}_1$ so as to efficiently prevent the partition wall from being damaged when the partition wall layer is etched by using a sandblast method. Further, each of the arc-shaped partition wall members 321 and 322, the first oblique partition wall members $\mathbf{311}_1$, and the first rib partition wall members $\mathbf{331}_1$ has a relatively narrow line width.

As regards the partition wall members disposed inside the first horizontal partition wall band $\mathbf{20}_1$, constant force acts in four directions, such that bending does not occur. However, since the arc-shaped partition wall members 321 and 322, the first oblique partition wall members $\mathbf{311}_1$, and the first rib partition wall members $\mathbf{331}_1$ disposed inside the first fan-shaped portion $\mathbf{30}_1$ are formed at the end of the first horizontal partition wall band $\mathbf{20}_1$, the balance of the force may be upset. Accordingly, a looseness may occur that is caused by the phenomenon that the bottom surface of each of the ends of the partition walls may be removed from the dielectric layer. However, in the present embodiment of the invention, the attractive force between the partition wall members in the panel is lowered by reducing the line width of each of the arc-shaped partition wall members 321 and 322, the first oblique partition wall members $\mathbf{311}_1$, and the first rib partition wall members $\mathbf{331}_1$, and thus the ends of the partition walls can be prevented from being lifted.

Figure 3:
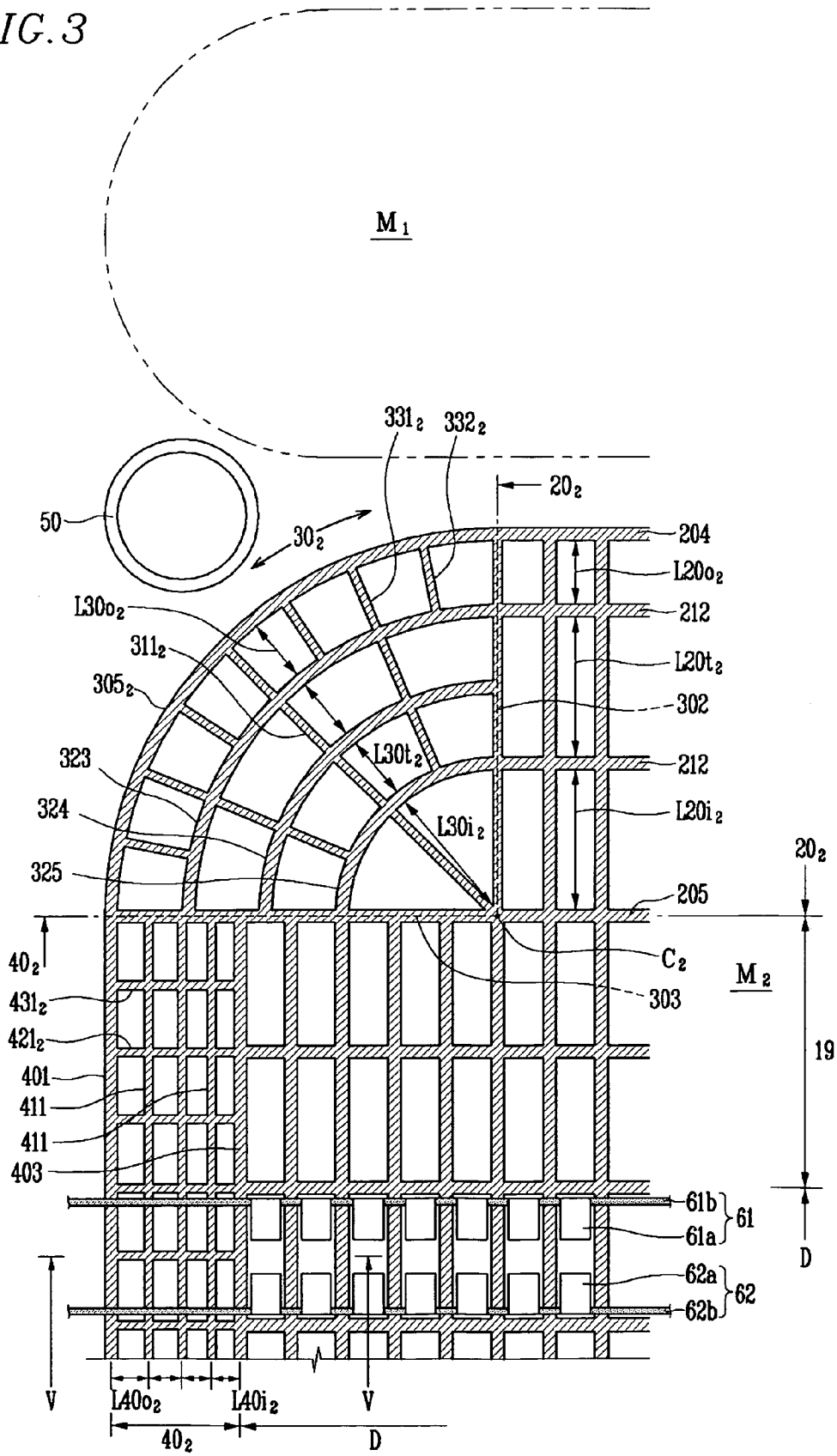
FIG. 3 is a partial plan view of a portion "B" shown in FIG. 1 in a magnified scale.

FIG. 3 is a partial plan view of a portion "B" shown in FIG. 1 in a magnified scale.

Referring to FIGS. 1 and 3, the second dummy area $M_2$ includes second fan-shaped portions $\mathbf{30}_2$ that are disposed on outside corners of the display region D, and second horizontal partition wall bands $\mathbf{20}_2$ and first vertical partition wall bands $\mathbf{40}_2$ that are disposed neighboring the second fan-shaped portions $\mathbf{30}_2$. Further, buffer partition wall bands 19 are formed between the display region D and the second horizontal partition wall bands $\mathbf{20}_2$. In one embodiment (not shown), the buffer partition wall bands 19 may also be formed between the display region D and the first vertical partition wall bands $\mathbf{40}_2$.

Each of the second fan-shaped portions $\mathbf{30}_2$ is surrounded by a vertical line portion 302 and a horizontal line portion 303, which intersect each other, and a second outer arc-shaped portion $\mathbf{305}_2$, which intersects both line portions 302 and 303 so as to form a fan-shaped region. A respective second horizontal partition wall band $\mathbf{20}_2$ comes in contact with the vertical line portion 302, and a respective first vertical partition wall band $\mathbf{40}_2$ comes in contact with the horizontal line portion 303.

In the present embodiment, the second outer arc-shaped portion $\mathbf{305}_2$ of a respective second fan-shaped portion 302 is spaced apart from a second intersection $C_2$ of the vertical line portion 301 and the horizontal line portion 303 at a constant distance. In addition, if the vertical line portion 302 is orthogonal to the horizontal line portion 303 (as shown in FIG. 3), the second fan-shaped portion $\mathbf{30}_2$ has a quadrisected circle shape.

A second oblique partition wall member $\mathbf{311}_2$ which linearly extends from the second intersection $C_2$ of the vertical line portion 302 and the horizontal line portion 303 to the second outer arc-shaped portion $\mathbf{305}_2$ is formed in the second fan-shaped portion $\mathbf{30}_2$ of the second dummy area $M_2$. The second oblique partition wall member $\mathbf{311}_2$ bisects an angle which the vertical line 302 and the horizontal line portion 303 make. Accordingly, in the present embodiment, if the vertical line portion 302 is orthogonal to the horizontal line portion 303, the angle that the second oblique partition wall member $\mathbf{311}_2$ and the vertical line portion 302 or the horizontal line portion 303 make can become 45 degrees.

Arc-shaped partition wall members 323, 324, and 325 which extend from one point of the vertical line portion 302 to one point of the horizontal line portion 303 are formed in the second fan-shaped portion $\mathbf{30}_2$ of the second dummy area $M_2$. In the present embodiment, three arc-shaped partition wall members 323, 324, and 325 are disposed between the second outer arc-shaped portion $\mathbf{305}_2$ and the second intersection $C_2$. In FIG. 3, a distance $L\mathbf{30}o_2$ between the second outer arc-shaped portion $\mathbf{305}_2$ and the adjacent arc-shaped partition wall member 323, distances $L\mathbf{30}t_2$ among two adjacent ones of the arc-shaped partition wall members 323, 324 and 325, and a distance $L\mathbf{30}i_2$ between the arc-shaped partition wall member 325 and the second intersection $C_2$ may be different from one another. In the present embodiment, the distance $L\mathbf{30}i_2$ between the second intersection $C_2$ and the adjacent arc-shaped partition wall member 325 is greater than the distance $L\mathbf{30}o_2$ between the second outer arc-shaped portion $\mathbf{305}_2$ and the adjacent arc-shaped partition wall member 323. The arc-shaped partition wall members 323, 324, and 325 (e.g., the members 323 and 325) are connected to the partition wall members (e.g., the members 212) of the second horizontal partition wall band $\mathbf{20}_2$ and the partition wall members of the first vertical partition wall band $\mathbf{40}_2$ in the extension direction thereof.

Further, second rib partition wall members $\mathbf{331}_2$, which linearly extend from the second outer arc-shaped portion $\mathbf{305}_2$ to the arc-shaped partition wall members 323, 324, and 325, and second rib partition wall members $\mathbf{332}_2$, which linearly extend from the second arc-shaped portion $\mathbf{305}_2$ to the arc-shaped partition wall member 323, are formed in the second fan-shaped portion $\mathbf{30}_2$ of the second dummy area $M_2$. In FIG. 3, the second rib partition wall members $\mathbf{331}_2$ and $\mathbf{332}_2$ have line widths less than those of the arc-shaped partition wall members 323, 324, and 325.

The second rib partition wall members $\mathbf{331}_2$ and $\mathbf{332}_2$ divide the arc-shaped partition wall members 323, 324, and 325 at constant intervals. The number of the second rib partition wall members $\mathbf{331}_2$ and $\mathbf{332}_2$ disposed between the second outer arc-shaped portion $\mathbf{305}_2$ and adjacent arc-shaped partition wall member 323 may be greater than the number of the second rib partition wall members $\mathbf{331}_2$ disposed among adjacent arc-shaped partition wall members 323, 324, and 325.

In addition, the second horizontal partition wall band $\mathbf{20}_2$ and the first vertical partition wall band $\mathbf{40}_2$ share the vertical line portion 302 and the horizontal line portion 303 of the second fan-shaped portion $\mathbf{30}_2$ of the second dummy area $M_2$.

That is, the vertical line portion 302 separates the second horizontal partition wall band $\mathbf{20}_2$ from the second fan-shaped portion $\mathbf{30}_2$, and the horizontal line portion 303 separates the first vertical partition wall band $\mathbf{40}_2$ from the second fan-shaped portion $\mathbf{30}_2$.

The second horizontal partition wall band $\mathbf{20}_2$ includes horizontal partition wall members parallel to one edge of the display region D and vertical partition wall members intersecting the horizontal partition wall members so as to form a plurality of second dummy cells. At least one horizontal partition wall member may be formed between an outermost horizontal partition wall member 204 and an innermost horizontal partition wall member 205 of the second horizontal partition wall band $\mathbf{20}_2$. In the present embodiment, two horizontal partition wall members 212 are formed therebetween. In FIG. 3, a distance $L\mathbf{20}o_2$ between the outermost horizontal partition wall member 204 and the adjacent horizontal partition wall member 212 is less than a distance $L\mathbf{20}i_2$ between the innermost horizontal partition wall member 205 and the adjacent horizontal partition wall member 212. Further, in the present embodiment, the distance $L\mathbf{20}i_2$ is equal to a distance $L\mathbf{20}t_2$ between the horizontal partition wall members 212 that are disposed between the outermost horizontal partition wall member 204 and the innermost horizontal partition wall member 205.

The first vertical partition wall band $\mathbf{40}_2$ includes horizontal partition wall member parallel to one edge of the display region D and vertical partition wall members intersecting the horizontal partition wall members so as to form a plurality of second dummy cells. At least one vertical partition wall member may be formed between an outermost vertical partition wall member 401 and an innermost vertical partition wall member 403 of the first vertical partition wall band $\mathbf{40}_2$. In the present embodiment, three vertical partition wall members 411 are formed therebetween. In FIG. 3, a distance $L\mathbf{40}o_2$ between the outermost vertical partition wall member 401 and the adjacent vertical partition wall member 411 is larger than distances among two adjacent ones of the vertical partition wall members 411 and a distance $L\mathbf{40}i_2$ between the innermost vertical partition wall member 403 and the adjacent vertical partition wall member 411. The distance $L\mathbf{40}i_2$ is smaller than the distance $L\mathbf{40}_2$ and the distance among the two adjacent ones of the vertical partition wall members 411. Further, a line width of the outermost vertical partition wall member 401 of the first vertical partition wall band $\mathbf{40}_2$ is greater than that of the vertical partition wall member 411 adjacent thereto.

Further, a horizontal partition wall member $\mathbf{421}_2$ intersecting the outermost vertical partition wall member 401 has a line width less than that of the outermost vertical partition wall member 401. As regards to the partition wall members (e.g., the vertical partition wall members 411) disposed inside the first vertical partition wall band $\mathbf{40}_2$, constant force acts in four directions, such that bending does not occur. However, the balance of force may be upset at the end of the outermost vertical partition wall member 401. Accordingly, a looseness may occur that is caused by the phenomenon that the bottom surface of each of the ends of the partition walls may be removed from the dielectric layer. In order to prevent this problem, the line width of the horizontal partition wall member $\mathbf{421}_2$ intersecting the outermost vertical partition wall member 401 in the first vertical partition wall band $\mathbf{40}_2$ is less than that of the horizontal partition wall member (or each of the horizontal partition wall members) in the display region D so as to reduce the attractive force between the partition wall members toward the panel. Therefore, the outermost vertical partition wall member 401 stands against the attractive force and thus the ends of the partition walls can be prevented from being lifted.

Furthermore, the first vertical partition wall band $\mathbf{40}_2$ includes a first bar partition wall member $\mathbf{431}_2$ which linearly extends from the outermost vertical partition wall member 401 through the vertical partition wall members 411 to the innermost vertical partition wall member 403. A line width of the first bar partition wall member $\mathbf{431}_2$ is less than that of the horizontal partition wall member in the display region D. The first bar partition wall member $\mathbf{431}_2$ allows the distance between adjacent horizontal partition wall members $\mathbf{421}_2$ to be small in each of the second dummy cells formed by the vertical partition wall members 411 and the horizontal partition wall members $\mathbf{421}_2$, such that the other vertical partition wall members 411 and the outermost vertical partition wall members 401 stand against the attractive force for bending the partition wall members toward the center of the panel when the partition walls are fired, and thus the ends of the partition walls can be prevented from being lifted.

The second outer arc-shaped portion $\mathbf{305}_2$ of the second fan-shaped portion $\mathbf{30}_2$ of the second dummy area $M_2$ is connected to the outermost horizontal partition wall member 204 of the second horizontal partition wall band $\mathbf{20}_2$ in one extension direction. In addition, the outermost horizontal partition wall member 204 of the second horizontal partition wall band $\mathbf{20}_2$ is formed in a linear shape.

Similarly, the second outer arc-shaped portion $\mathbf{305}_2$ of the second fan-shaped portion $\mathbf{30}_2$ of the second dummy area $M_2$ is connected to the outermost vertical partition wall member 401 of the first vertical partition wall band $\mathbf{40}_2$ in the other extension direction. In addition, the outermost vertical partition wall member 401 of the second horizontal partition wall band $\mathbf{40}_2$ is formed in a linear shape.

Moreover, an island partition wall member 50 may be disposed between one front end of the first dummy area $M_1$ and one front end of adjacent second dummy area $M_2$. That is, the island partition wall member 50 is separately spaced apart from the dummy areas $M_1$ and $M_2$ between the first fan-shaped portion $\mathbf{30}_1$ of the first dummy area $M_1$ and the second fan-shaped portion $\mathbf{30}_2$ of the second dummy area $M_2$. The island partition wall member 50 is spaced apart from the front end of the first dummy area $M_1$ and the front end of the second dummy area $M_2$, such that a supply and exhaust path of the discharge gas is formed in the periphery of the island partition wall member 50 so as to smoothly supply and exhaust the discharge gas when the discharge gas is supplied and exhausted through an exhaust tube H (shown in FIG. 1), while the resonance space is reduced. The island partition wall member 50 may have various shapes and, in one embodiment, has a circular or ring-shaped section. Accordingly, the island partition wall member may be formed in a column or cylindrical shape.

Further, a line width of the frit 12 for sealing the front substrate 10 and the rear substrate 15 may be greater than an interval between an inner surface of the frit 12 and an outer surface of the first dummy area $M_1$ in order to reduce the resonance space of the redundant area E, as shown in FIG. 1. The line width of the frit 12 may be 2 to 3 times as large as the interval between the inner surface of the frit 12 and the outer surface of the first dummy area $M_1$.

Generally, in a comparison example, the interval is 6 mm, and the line width of the frit 12 is 4 to 5 mm. However, in the embodiment of the present invention, the first dummy area $M_1$ is provided, and thus the interval is set to 1 to 2 mm, and the line width of the frit 12 is set to 5 to 7 mm. In the embodiment of the present invention, it can be experimentally seen that front and rear noises are reduced as compared with the comparison example.

Figure 4:
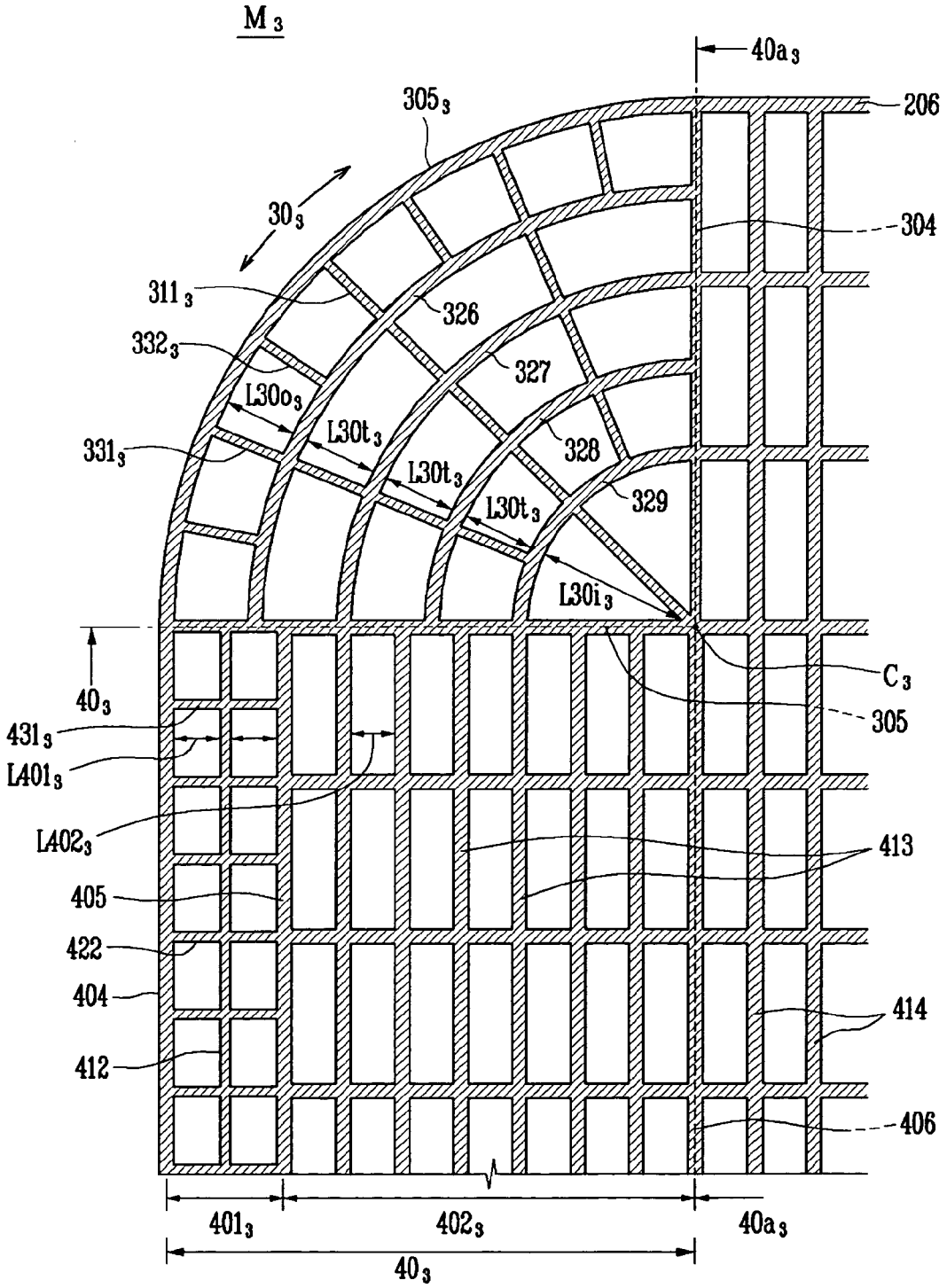
FIG. 4 is a partial plan view of a portion "C" shown in FIG. 1 in a magnified scale.

FIG. 4 is a partial plan view of a portion "C" shown in FIG. 1 in a magnified scale.

Referring to FIG. 4, the third dummy area $M_3$ is disposed on both sides of the second dummy area $M_2$ in the extension direction of the horizontal partition wall members (e.g., the horizontal wall members 204, 205, and/or 212 of FIG. 3). Each third dummy area $M_3$ includes a third fan-shaped portion $\mathbf{30}_3$ and a second vertical partition wall band $\mathbf{40}_3$.

The third fan-shaped portion $\mathbf{30}_3$ is disposed on a corner of the third dummy area $M_3$ and is surrounded by a vertical line portion 304 and a horizontal line portion 305 intersecting each other and a third outer arc-shaped portion $\mathbf{305}_3$ intersecting both line portions 304 and 305 so as to form a fan-shaped region. The second vertical partition wall band $\mathbf{40}_3$ comes in contact with the horizontal line portion 305 of the third fan-shaped portion $\mathbf{30}_3$.

Furthermore, the third dummy area $M_3$ including the third fan-shaped portion $\mathbf{30}_3$ and the second vertical partition wall band $\mathbf{40}_3$ may be connected to the second dummy area $M_2$. In the present embodiment, the third dummy area $M_3$ is connected to the second dummy area $M_2$ through a third vertical partition wall band $\mathbf{40}a_3$. The third vertical partition wall band $\mathbf{40}a_3$ comes in contact with the vertical line portion 304 of the third fan-shaped portion $\mathbf{30}_3$ and the second vertical partition wall band $\mathbf{40}_3$ connected thereto and is connected to the second dummy area $M_2$.

In the present embodiment, the third outer arc-shaped portion $\mathbf{305}_3$ of the third fan-shaped portion $\mathbf{30}_3$ is spaced apart from a third intersection $C_3$ of the vertical line portion 304 and the horizontal line portion 305 at a constant interval. In addition, if the vertical line portion 304 is orthogonal to the horizontal line portion 305, the third fan-shaped portion $\mathbf{30}_3$ has a quadrisected circle shape.

A third oblique partition wall member $\mathbf{311}_3$ which linearly extends from the intersection $C_3$ of the vertical line portion 304 and the horizontal line portion 305 to the third outer arc-shaped portion $\mathbf{305}_3$ is formed in the third fan-shaped portion $\mathbf{30}_3$ of the third dummy area $M_3$. The third oblique partition wall member $\mathbf{311}_3$ is formed so as to bisect an angle which the vertical line portion 304 and the horizontal line portion 305 make. Accordingly, in the present embodiment, if the vertical line portion 304 is orthogonal to the horizontal line portion 304, the angle that the third oblique partition wall member $\mathbf{311}_3$ and the vertical line portion 304 or the horizontal line portion 305 make can become 45 degrees.

Arc-shaped partition wall members 326, 327, 328, and 329 which extend from one point of the vertical line portion 304 to one point of the horizontal line portion 305 are formed in the third fan-shaped portion $\mathbf{30}_3$ of the third dummy area $M_3$. In the present embodiment, four arc-shaped partition wall members 326, 327, 328, and 329 are disposed between the third outer arc-shaped portion $\mathbf{305}_3$ and the third intersection $C_3$. In FIG. 4, a distance $L\mathbf{30}o_3$ between the third outer arc-shaped portion $\mathbf{305}_3$ and the adjacent arc-shaped partition wall member 326, a distance $L\mathbf{30}t_3$ among two adjacent ones of the arc-shaped partition wall members 326, 327, 328, and 329, and a distance $L\mathbf{30}i_3$ between the arc-shaped partition wall member 329 and the third intersection $C_3$ may be different from one another. In the present embodiment, the distance $L\mathbf{30}i_3$ between the arc-shaped partition wall member 329 and the third intersection $C_3$ is greater than the distance $L\mathbf{30}o_3$ between the third outer arc-shaped portion $\mathbf{305}_3$ and the adjacent arc-shaped partition wall member 326. The arc-shaped partition wall members 326, 327, 328, and 329 are connected to the partition wall members of the third vertical partition wall band $\mathbf{40}a_3$ in the extension direction thereof and are connected to the partition wall members of the second vertical partition wall band $\mathbf{40}_3$.

Further, third rib partition wall members $\mathbf{331}_3$, which linearly extend from the third outer arc-shaped portion $\mathbf{305}_3$ to the arc-shaped partition wall members 326, 327, 328, and 329, and third rib partition wall members $\mathbf{332}_2$, which linearly extend from the second arc-shaped portion $\mathbf{305}_3$ to the arc-shaped wall member 326, are formed in the third fan-shaped portion $\mathbf{30}_3$ of the third dummy area $M_3$. In FIG. 4, a line width of each of the third rib partition wall members $\mathbf{331}_3$ and $\mathbf{332}_3$ is less than that of each of the arc-shaped partition wall members 326, 327, 328, and 329.

The third rib partition wall members $\mathbf{331}_3$ and $\mathbf{332}_3$ may be formed so as to divide the arc-shaped partition wall members 326, 327, 328, and 329 at constant intervals. Further, the number of the third rib partition wall members $\mathbf{331}_3$ and $\mathbf{332}_3$ disposed between the third outer arc-shaped portion $\mathbf{305}_3$ and adjacent arc-shaped partition wall member 326 is greater than the number of the rib partition wall members $\mathbf{331}_3$ disposed among adjacent arc-shaped partition wall members 326, 327, 328 and 329.

In addition, the third vertical partition wall band $\mathbf{40}a_3$ and the second vertical partition wall band $\mathbf{40}_3$ share the vertical line portion 304 and the horizontal line portion 305 of the third fan-shaped portion $\mathbf{30}_3$ of the third dummy area $M_3$. That is, the vertical line portion 304 separates the third fan-shaped portion $\mathbf{30}_3$ from the third vertical partition wall band $\mathbf{40}a_3$, and the horizontal line portion 305 separates the third fan-shaped portion $\mathbf{30}_3$ from the second vertical partition wall band $\mathbf{40}_3$.

The second vertical partition wall band $\mathbf{40}_3$ includes horizontal partition wall members connected to horizontal partition wall members of the third vertical partition wall band $\mathbf{40}a_3$ and vertical partition wall members intersecting the horizontal partition wall members so as to form a plurality of third dummy cells. At least one vertical partition wall member may be formed between an outermost vertical partition wall member 404 and an innermost vertical partition wall member 406 of the second vertical partition wall band $\mathbf{40}_3$.

The second vertical partition wall band $\mathbf{40}_3$ includes an outer vertical partition wall band $\mathbf{401}_3$ that is outwardly connected to the horizontal line portion 305 of the third fan-shaped portion 303 and an inner vertical partition wall band $\mathbf{402}_3$ that is disposed inside the outer vertical partition wall band $\mathbf{401}_3$ and is inwardly connected to the horizontal line portion 305.

At least one vertical partition wall member may be formed between the outermost vertical partition wall member 404 and the innermost vertical partition wall member 405 of the outer vertical partition wall band $\mathbf{401}_3$. In the present embodiment, one vertical partition wall member 412 is formed therebetween.

The outer vertical partition wall band $\mathbf{401}_3$ and the inner vertical partition wall band $\mathbf{402}_3$ share the innermost vertical partition wall member 405. Further, at least one vertical partition wall member may be formed between the innermost vertical partition wall member 406 and the vertical partition wall member 405, which is also the outermost vertical partition wall member of the inner vertical partition wall band $\mathbf{402}_3$. In the present embodiment, six vertical partition wall members 413 are formed therebetween. The second vertical partition wall band $\mathbf{40}_3$ and the third vertical partition wall band $\mathbf{40}a_3$ share the innermost vertical partition wall member 406.

In FIG. 4, a distance L401$_3$ between the outermost vertical wall member 404 and the vertical partition wall member 412 or between the vertical wall members 412 and 405 in the outer vertical partition wall band 401$_3$ of the second vertical partition wall band 40$_3$ is greater than a distance L402$_3$ between two adjacent ones of the vertical partition wall members 413 in the inner vertical partition wall band 402$_3$. Further, a line width of the vertical partition wall member 412 of the outer vertical partition wall band 401$_3$ of the second vertical partition wall band 40$_3$ is less than that of each of the vertical partition wall members 413 of the inner vertical partition wall band 402$_3$. Further, a line width of the outermost vertical partition wall member 404 is greater than that of the adjacent vertical partition wall member 412.

Further, the third vertical partition wall band 40*a*$_3$ shares the innermost vertical partition wall member 406 of the second vertical partition wall band 40$_3$ and has at least one vertical partition wall member 414 between the innermost vertical partition wall member 406 and the outermost vertical partition wall member 401 (see FIG. 3) of the second dummy area $M_2$.

Further, a line width of the horizontal partition wall member 422 intersecting the outermost vertical partition wall member 404 is less than that of the outermost vertical partition wall member 404.

As regards to the partition wall members (e.g., the vertical partition wall member 413) disposed inside the second vertical partition wall band 403, constant force acts in four directions, such that bending does not occur. However, the balance of force may be upset at the end of the outermost vertical partition wall member 404. Accordingly, a looseness may occur that is caused by the phenomenon that the bottom surface of each of the ends of the partition walls may be removed from the dielectric layer. In order to prevent this problem, the line width of the horizontal partition wall member 422 intersecting the outermost vertical partition wall member 404 in the outermost vertical partition wall band 401$_3$ of the second vertical partition wall band 40$_3$ is less than that of the horizontal partition wall member in the inner vertical partition wall band 402$_3$ so as to reduce the attractive force between the partition wall members to the panel. As a result, the outermost vertical partition wall member 404 stands against the attractive force, and thus the ends of the partition walls can be prevented from being lifted.

Furthermore, the outer vertical partition wall band 401$_3$ of the second vertical partition wall band 40$_3$ includes a second bar partition wall member 431$_3$ which linearly extends from the outermost vertical partition wall member 404 through the vertical partition wall member 412 to the innermost vertical partition wall member 405. A line width of the second bar partition wall member 431$_3$ is less than that of each of the horizontal partition wall members in the inner vertical partition wall band 402$_3$. The second bar partition wall member 431$_3$ allows the other vertical partition wall member 412 and the outermost vertical partition wall member 404 to stand against the attractive force for bending the partition wall member toward the center of the panel when the partition walls are fired, and thus the ends of the partition walls can be prevented from being lifted.

The third outer arc-shaped portion 305$_3$ of the third fan-shaped portion 303 of the third dummy area $M_3$ is connected to the outermost horizontal partition wall member 206 of the third vertical partition wall band 40*a*$_3$ in one extension direction. In addition, the outermost horizontal partition wall member 206 of the third vertical partition wall band 40*a*$_3$ is formed in a linear shape.

Similarly, the third outer arc-shaped portion 305$_3$ of the third fan-shaped portion 30$_3$ of the third dummy area $M_3$ is connected to the outermost vertical partition wall member 404 of the second vertical partition wall band 40$_3$ in the other extension direction. In addition, the outermost horizontal partition wall member 404 of the second vertical partition wall band 40$_3$ is formed in a linear shape.

The outermost horizontal partition wall member 206 and the outermost horizontal partition wall member 404 are formed in the linear shapes, and thus they serve as supports for preventing the ends of the partition walls from loosening.

Figure 5:
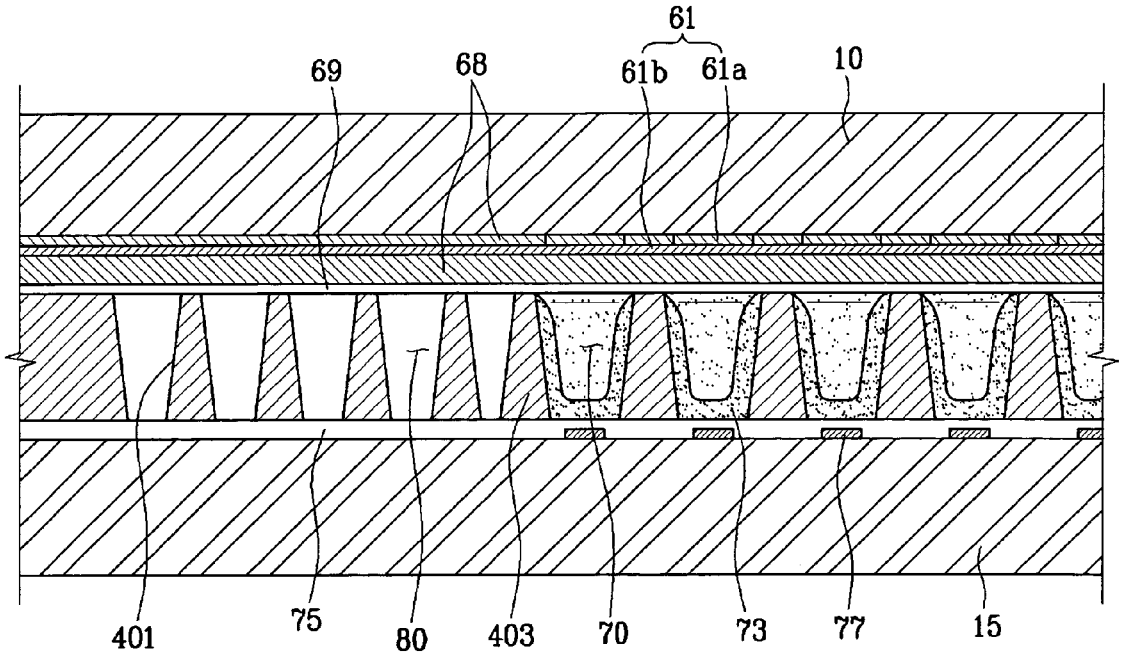
FIG. 5 is a partial cross-sectional view taken along a cut-line V-V of FIG. 3.

FIG. 5 is a partial cross-sectional view taken along a cut-line V-V of FIG. 3.

Referring to FIG. 5, in the plasma display panel according to the present embodiment, the front substrate 10 and the rear substrate 15 face each other at a predetermined gap and discharge cells 70 are disposed between both the substrates 10 and 15 to emit visible light using a separate discharge mechanism for each discharge cell 70 to display an image.

Address electrodes 77 are formed on the rear substrate 15 along one direction, and a dielectric layer 75 is formed on the entire surface of the rear substrate to cover the address electrodes 77. As described above, the partition walls have a predetermined pattern, and the discharge cells 70 and the dummy cells 80 are formed on the dielectric layer 75. Luminescent layers 73 for generating visible light of red, green and blue are coated in the discharge cells 70 and serve as pixels.

In addition, display electrodes 61 and 62 (see FIG. 3) are formed on one surface of the front substrate 10 opposing the rear substrate 15 along the direction intersecting (crossing-over) the address electrodes 77. The display electrodes 61 and 62 may form a discharge gap therebetween in the discharge cell 70 and face each other. In the present embodiment, the display electrodes 61 and 62 include transparent electrodes 61*a* and 62*a* for forming the discharge gap and bus electrodes 61*b* and 62*b* made of metal electrodes for ensuring conductivity of the transparent electrodes 61*a* and 62*a*, respectively. However, the display electrodes may be formed of only the metal electrodes, and the shapes thereof are not limited to those shown in the drawings.

A dielectric layer 68 covering the display electrodes 61 and 62 may be formed, and an MgO protective film 69 for protecting the dielectric layer 68 and increasing an emission coefficient of a secondary electron during the discharging may also be formed.

Figure 6:
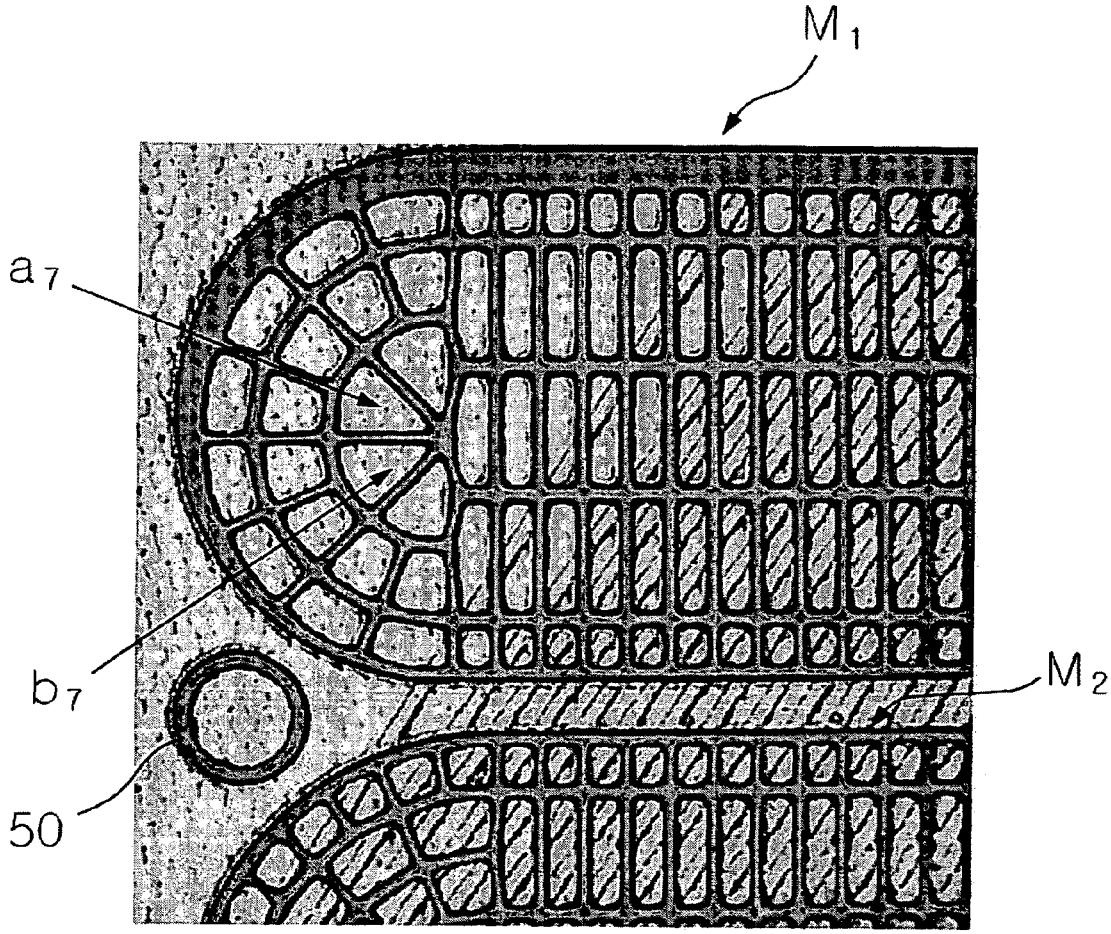
FIG. 6 is an image of a first dummy area that is disposed on an upper side or a lower side of the plasma display panel according to the embodiment of FIG. 1 in a magnified scale.
Figure 7A:
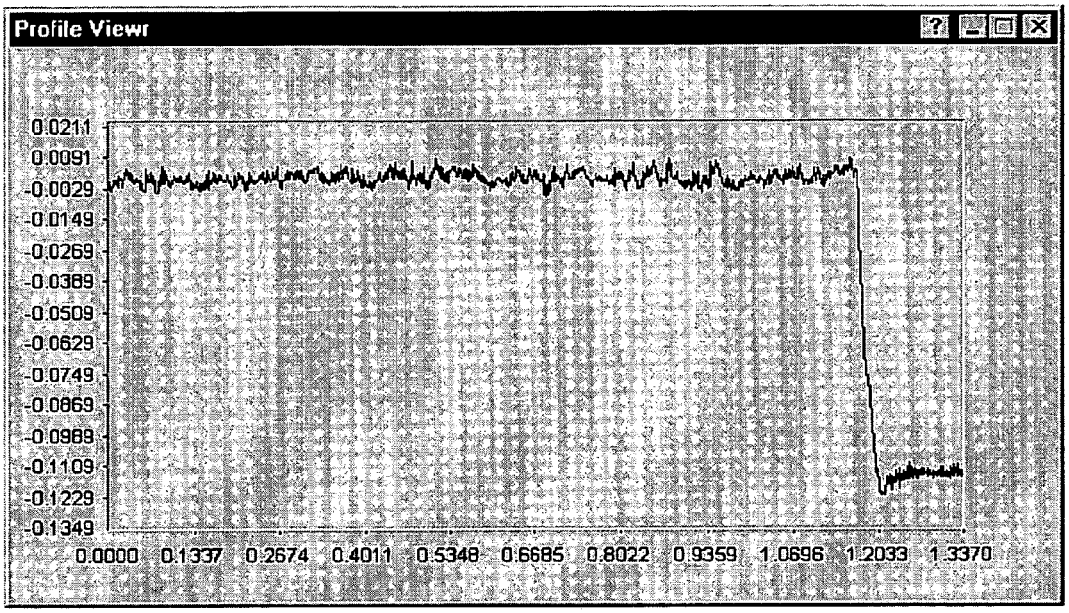
FIG. 7A is a graph showing a profile of partition wall members that are formed along the direction of an arrow "$a_7$" shown in FIG. 6.
Figure 7B:
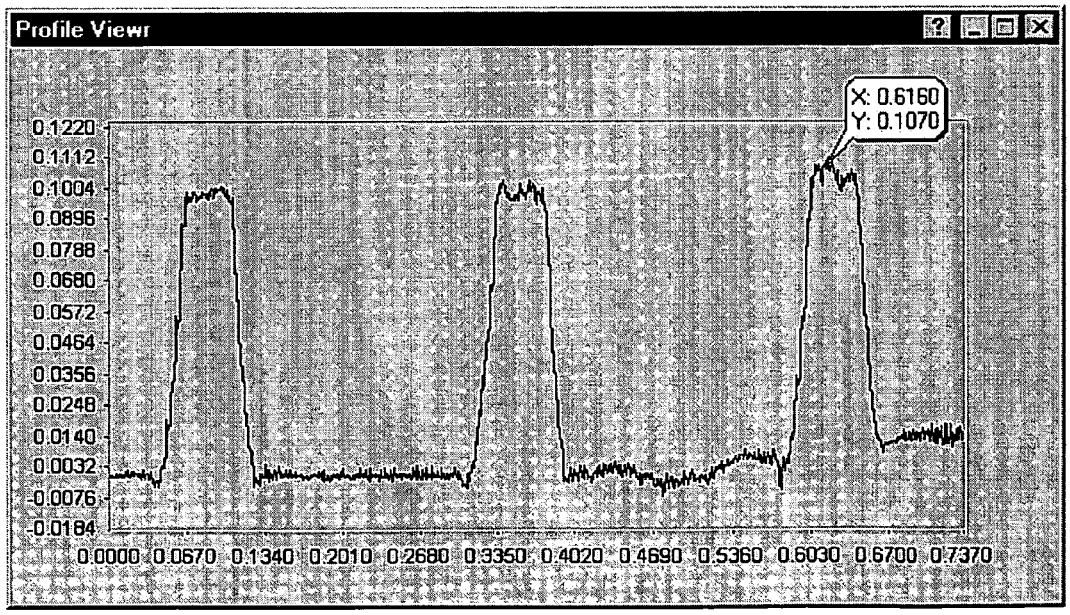
FIG. 7B is a graph showing a profile of partition wall members that are formed along the direction of an arrow "$b_7$" shown in FIG. 6.

FIG. 6 is an image of a first dummy area that is disposed on an upper side or a lower side of the plasma display panel according to the embodiment of FIG. 1 in a magnified scale. FIGS. 7A and 7B are graphs of profiles showing partition wall members that are formed along the directions of arrows "$a_7$" and "$b_7$" shown in FIG. 6, respectively.

As shown in FIGS. 7A and 7B, the ends of the partition walls of the first fan-shaped portion 30$_1$ of the first dummy area $M_1$ do not loosen and the heights thereof are substantially equal to those of the inner partition walls.

Figure 8:
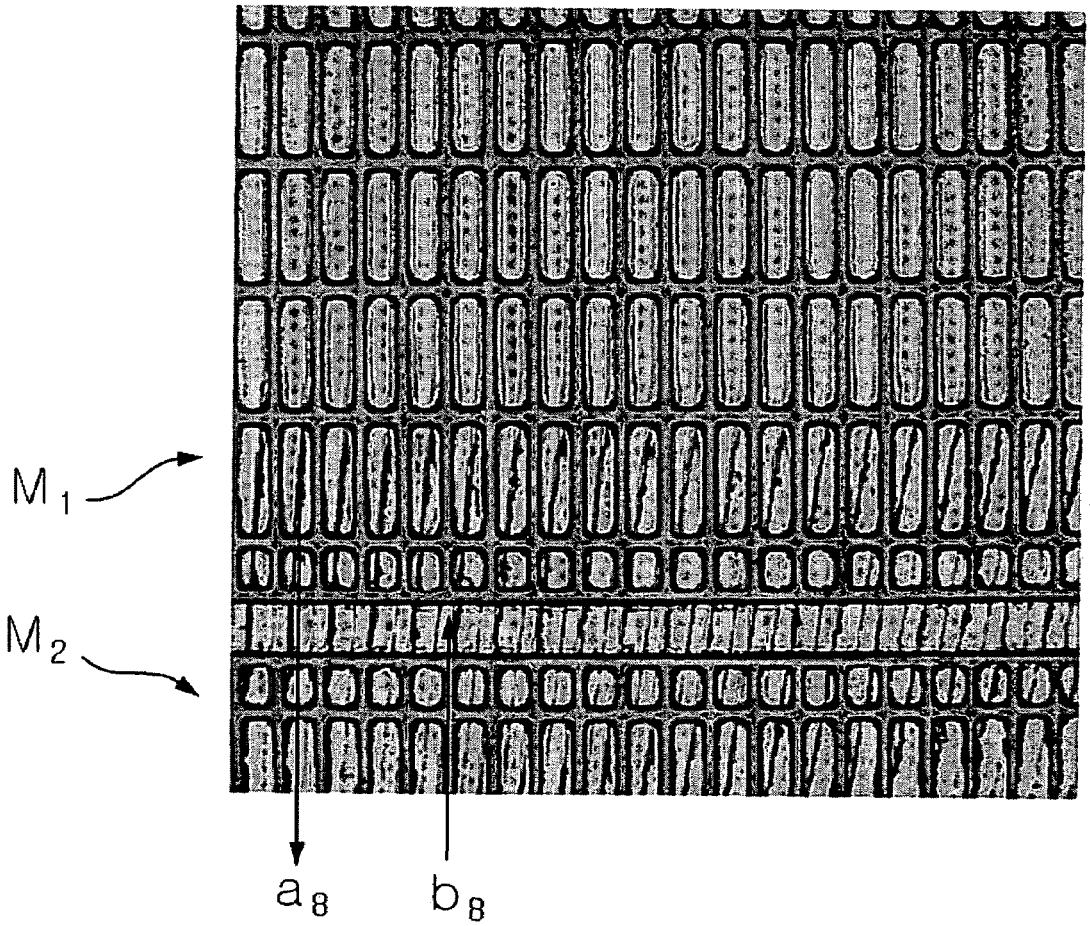
FIG. 8 is an image of a space between a first dummy area and a second dummy area that are disposed on an edge of the plasma display panel according to the embodiment of FIG. 1 in a magnified scale.
Figure 9A:
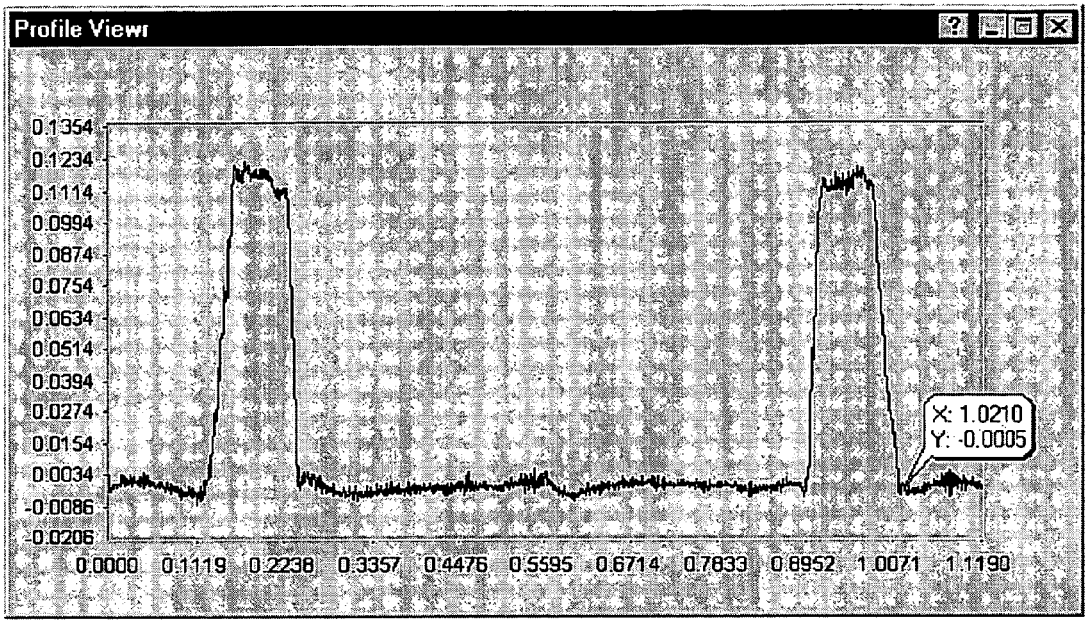
FIG. 9A is a graph showing a profile of partition wall members that are formed along the direction of an arrow "$a_8$" shown in FIG. 8.
Figure 9B:
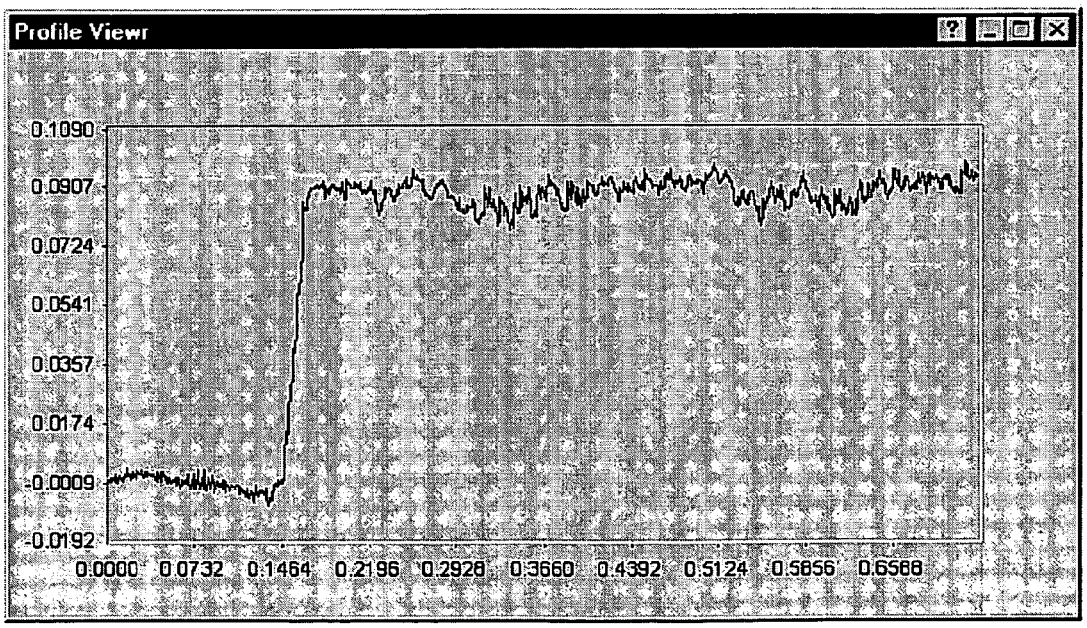
FIG. 9B is a graph showing a profile of partition wall members that are formed along the direction of an arrow "$b_8$" shown in FIG. 8.

FIG. 8 is an image of a space between a first dummy area and a second dummy area disposed on one edge of the plasma display panel according to the embodiment of FIG. 1 in a magnified scale. FIGS. 9A and 9B are graphs showing profiles of partition wall members that are formed along the directions of arrows "$a_8$" and "$b_8$" shown in FIG. 8, respectively.

As shown in FIGS. 9A and 9B, the first horizontal partition wall band 20$_1$ of the first dummy area $M_1$ and the end of the second dummy area $M_2$ do not loosen and the heights thereof are substantially equal to those of the inner partition walls.

Figure 10:
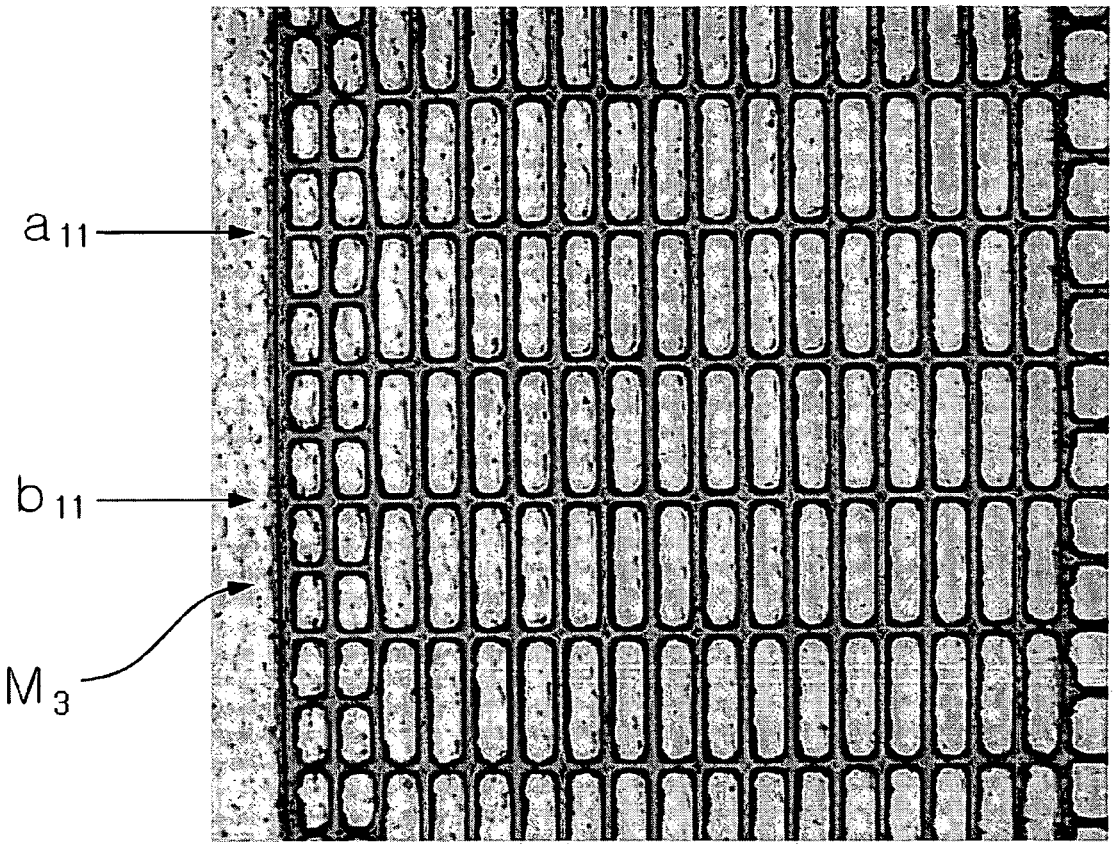
FIG. 10 is an image of a third dummy area that is disposed on a left side or a right side of the plasma display panel according to the embodiment of FIG. 1 in a magnified scale.
Figure 11A:
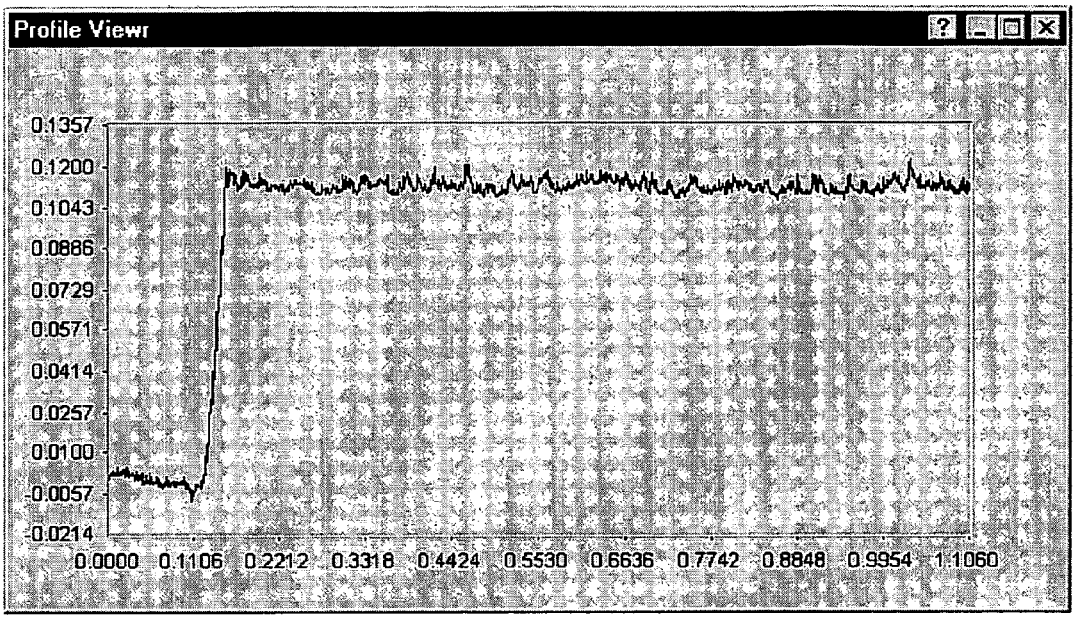
FIG. 11A is a graph showing a profile of partition wall members that are formed along the direction of an arrow "$a_{11}$" shown in FIG. 10.
Figure 11B:
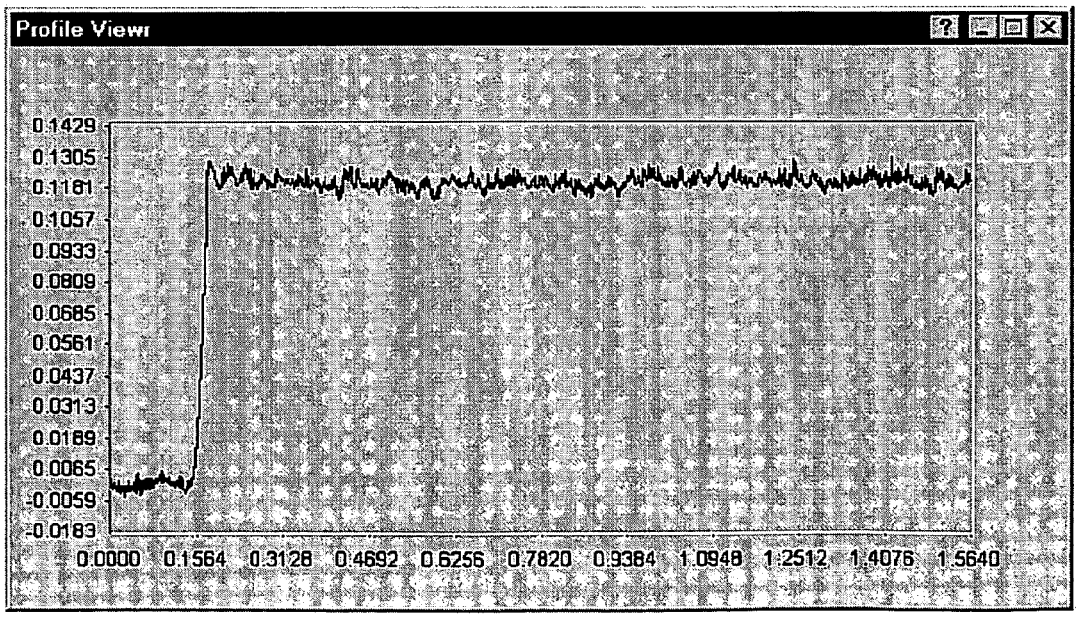
FIG. 11B is a graph showing a profile of partition wall members that are formed along the direction of an arrow "$b_{11}$" shown in FIG. 10.
Figure 12:
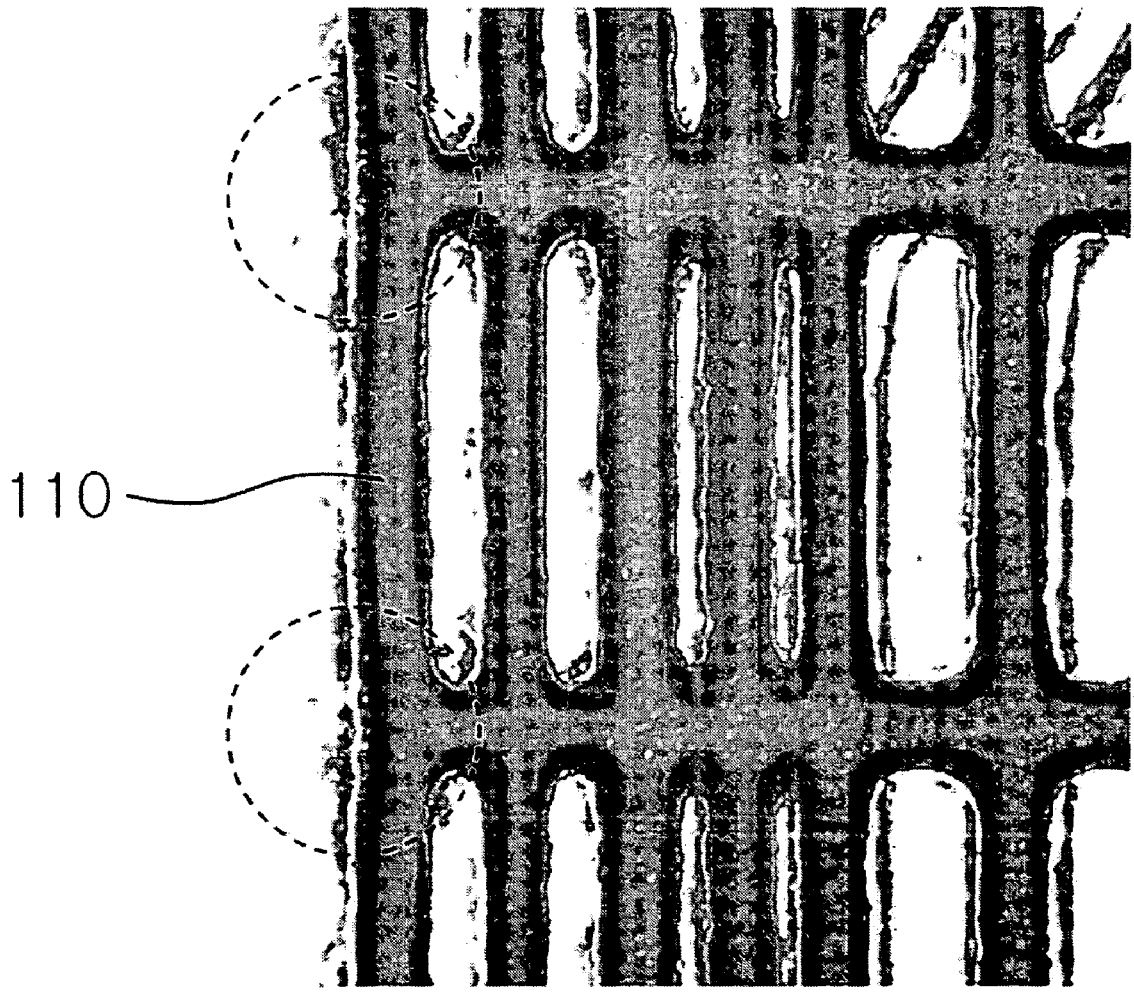
FIG. 12 is an image of partition walls that are disposed on the left side or the right side of a plasma display panel in a magnified scale.
Figure 13:
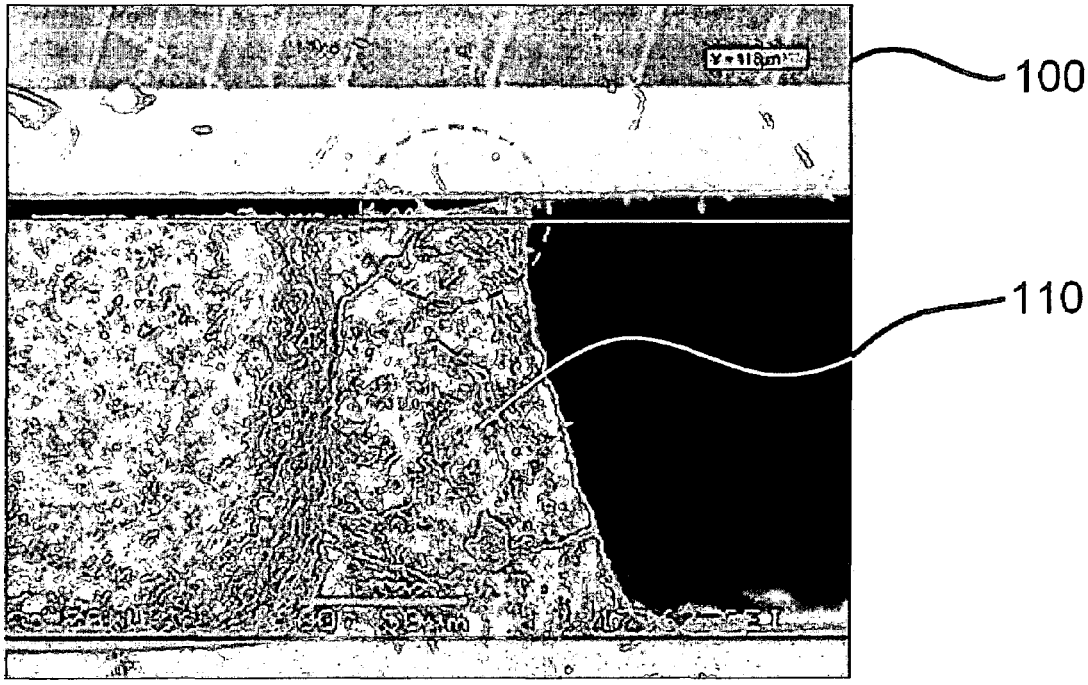
FIG. 13 is a photo showing the state in which the partition walls of the plasma display panel of FIG. 12 loosen at the end thereof.

FIG. 10 is an image of a third dummy area that is disposed on a left side or a right side of the plasma display panel according to the embodiment of FIG. 1 in a magnified scale. FIGS. 11A and 11B are graphs showing profiles of partition wall members formed along the directions of arrows "$a_{11}$" and "$b_{11}$" shown in FIG. 10, respectively.

As shown in FIGS. 11A and 11B, the outermost vertical partition wall member 404 of the second vertical partition wall band $\mathbf{40}_3$ of the third dummy area $M_3$ are not bent toward the center of the panel, the end of the third dummy area $M_3$ does not loosen, and the heights thereof are substantially equal to those of the inner partition walls.

As described above, according to a plasma display panel of the present invention, a first dummy area is disposed in a non-display region spaced apart from a display region, and a line width of a frit for sealing a front substrate and a rear substrate increases so as to reduce a resonance space formed between the frit and a plurality of dummy partition walls. Accordingly, noise can be prevented from occurring in the resonance space and a discharge gas can be smoothly supplied and exhausted. The smooth supply and exhaust of the discharge gas prevents a brightness of the plasma display panel from deteriorating.

Furthermore, in one embodiment, first, second, and third fan-shaped portions are provided in first, second, and third dummy areas formed in a non-display region. Further, a first horizontal partition wall band, a second horizontal partition wall band (and/or a first vertical partition wall band), and a second vertical partition wall band are provided adjacent to the first, second, and third fan-shaped portions, respectively. Accordingly, bending of a dummy partition wall and a looseness of the outer end of the dummy partition wall due to the attractive force can be prevented when the partition wall paste is contracted after firing.

As such, by preventing bending of the dummy partition wall and the looseness of the end of the partition wall, a gap does not occur between the partition wall and a front substrate, such that noise can be prevented from occurring.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel comprising:

a front substrate and a rear substrate facing each other;

a plurality of address electrodes and a plurality of display electrodes spaced apart from each other and crossing each other between the front substrate and the rear substrate; and a plurality of partition walls forming a display region while partitioning a plurality of discharge cells and forming a non-display region along a periphery of the display region between the front substrate and the rear substrate, wherein the non-display region includes a plurality of dummy areas having a plurality of dummy cells partitioned by a plurality of dummy partition walls spaced apart from the display region at a plurality of intervals, wherein each of the dummy areas includes a horizontal partition wall band formed in a band shape in parallel to one edge of the display region and a fan-shaped portion at both ends of the horizontal partition wall band, the fan-shaped portion being surrounded by an outer arc-shaped portion, wherein the horizontal partition wall band includes at least one horizontal partition wall member between an outermost horizontal partition wall member and an innermost horizontal partition wall member, and wherein the fan-shaped portion includes an oblique partition wall member linearly extending from a center of a line to the outer arc-shaped portion, the line connecting a front end of the outermost horizontal partition wall member to a front end of the innermost horizontal partition wall member.

2. The plasma display panel of claim 1, wherein the dummy areas are disposed on both sides of the display region along an extension direction of the address electrodes.

3. The plasma display panel of claim 1, wherein the at least one horizontal partition wall member comprises a plurality of horizontal partition wall members, wherein a distance between the outermost horizontal partition wall member and one of the plurality of the horizontal partition wall members adjacent to the outermost horizontal partition wall member and a distance between the innermost horizontal partition wall member and one of the plurality of the horizontal partition wall members adjacent to the innermost horizontal partition wall member are each less than a distance between a pair of the plurality of the horizontal partition wall members disposed between the outermost horizontal partition wall member and the innermost horizontal partition wall member.

4. The plasma display panel of claim 1, wherein a line width of the outermost horizontal partition wall member is greater than that of any other horizontal partition wall members.

5. The plasma display panel of claim 1, wherein the oblique partition wall member comprises a plurality of oblique partition wall members to angularly quadrisect the fan-shaped portion.

6. The plasma display panel of claim 1, wherein a line connecting the front end of the outermost horizontal partition wall member to the front end of the innermost horizontal partition wall member is shared by the horizontal partition wall band and the fan-shaped portion.

7. The plasma display panel of claim 1, wherein the outer arc-shaped portion is connected to the outermost horizontal partition wall member of the horizontal partition wall band in an extension direction thereof, and the outermost horizontal partition wall member of the horizontal partition wall band is formed in a linear shape.

8. The plasma display panel of claim 1, wherein the outer arc-shaped portion is connected to the innermost horizontal partition wall member of the horizontal partition wall band in an extension direction thereof and the innermost horizontal partition wall member of the horizontal partition wall band is formed in a linear shape.

9. The plasma display panel of claim 1, wherein the outer arc-shaped portion has a line width that is gradually widened in a direction from the innermost horizontal partition wall member to the outermost horizontal partition wall member of the horizontal partition wall band.

10. The plasma display panel of claim 1, wherein the fan-shaped portion includes a plurality of arc-shaped partition wall members respectively extending from one point of the horizontal partition wall band to another point thereof.

11. The plasma display panel of claim 10, wherein a distance between the outer arc-shaped portion of the fan-shaped portion and one of the plurality of the arc-shaped partition wall members adjacent to the outer arc-shaped portion is less than a distance between the horizontal partition wall band and one of the plurality of arc-shaped partition wall members adjacent to the horizontal partition wall band.

12. The plasma display panel of claim 10, wherein the fan-shaped portion includes a plurality of rib partition wall members linearly extending from the outer arc-shaped portion to at least one of the plurality of arc-shaped partition wall members and/or between adjacent ones of the plurality of arc-shaped partition wall members.

13. The plasma display panel of claim 12, wherein the rib partition wall members divide the plurality of arc-shaped partition wall members at constant intervals.

14. The plasma display panel of claim 12, wherein each of the rib partition wall members has a line width less than that of each of the plurality of arc-shaped partition wall members.

15. The plasma display panel of claim 1, wherein a line width of a frit for sealing the front substrate and the rear substrate is greater than an interval between an inner surface of the frit and an outer surface of the dummy areas.

16. The plasma display panel of claim 15, wherein the line width of the frit is 2 to 3 times as large as the interval between the inner surface of the frit and the outer surface of the at least one of the dummy areas.

17. A plasma display panel comprising:

a front substrate and a rear substrate facing each other;

a plurality of address electrodes and a plurality of display electrodes spaced apart from each other and crossing each other between the front substrate and the rear substrate; and a plurality of partition walls forming a display region while partitioning a plurality of discharge cells and forming a non-display region along a periphery of the display region between the front substrate and the rear substrate, wherein the non-display region includes a first dummy area having a plurality of first dummy cells partitioned by a plurality of first dummy partition walls extending from a plurality of partition walls disposed in the display region and a second dummy area having a plurality of second dummy cells partitioned by a plurality of second dummy partition walls spaced apart from the first dummy area, and wherein the first dummy area includes:

a first fan-shaped portion disposed outside the display region and surrounded by a vertical line portion and a horizontal line portion intersecting each other and a first outer arc-shaped portion intersecting both the vertical line portion and the horizontal line portion, wherein the first fan-shaped portion includes a first oblique partition wall member linearly extending from an intersection of the vertical line portion and the horizontal line portion to the first outer arc-shaped portion;

a first horizontal partition wall band contacting the vertical line portion of the first fan-shaped portion; and a first vertical partition wall band contacting the horizontal line portion of the first fan-shaped portion.

18. The plasma display panel of claim 17, wherein an island partition wall member spaced apart from the first and second dummy areas is separately provided between the first fan-shaped portion of the first dummy area and the second dummy area.

19. The plasma display panel of claim 18, wherein the island partition wall member has a circular or ring-shaped section.

20. The plasma display panel of claim 17, wherein the first fan-shaped portion includes a plurality of arc-shaped partition wall members respectively extending from one point of the vertical line portion to one point of the horizontal line portion.

21. The plasma display panel of claim 20, wherein the first fan-shaped portion includes a plurality of first rib partition wall members linearly extending from the first outer arc-shaped portion to at least one of the plurality of arc-shaped partition wall members and/or between adjacent ones of the plurality of arc-shaped partition wall members.

22. The plasma display panel of claim 17, wherein the first fan-shaped portion includes a plurality of arc-shaped partition wall members, and wherein the plurality arc-shaped partition wall members are connected to at least one of a plurality of partition wall members of the first horizontal partition wall band and at least one of a plurality of partition wall members of the first vertical partition wall band in respective extension directions thereof.

23. The plasma display panel of claim 17, wherein the vertical line portion and the horizontal line portion of the first fan-shaped portion are shared with the first horizontal partition wall band and the first vertical partition wall band, respectively.

24. The plasma display panel of claim 17, wherein the first horizontal partition wall band includes at least one horizontal partition wall member between an outermost horizontal partition wall member and an innermost horizontal partition wall member, and a distance between the outermost horizontal partition wall member and one of the at least one horizontal partition wall member adjacent to the outermost horizontal partition wall member is less than a distance between the innermost horizontal partition wall member and one of the at least one of the horizontal partition wall member adjacent to the innermost horizontal partition wall member.

25. The plasma display panel of claim 17, wherein the first vertical partition wall band includes at least one vertical partition wall member between an outermost vertical partition wall member and an innermost vertical partition wall member, and a distance between the outermost vertical partition wall member and one of the at least one vertical partition wall member adjacent to the outermost vertical partition wall member is larger than a distance between the innermost vertical partition wall member and one of the at least one vertical partition wall member adjacent to the innermost vertical partition wall member.

26. The plasma display panel of claim 17, wherein the first outer arc-shaped portion is connected to an outermost horizontal partition wall member of the first horizontal partition wall band in an extension direction thereof, and the outermost horizontal partition wall member of the first horizontal partition wall band is formed in a linear shape.

27. The plasma display panel of claim 17, wherein the first outer arc-shaped portion is connected to an outermost vertical partition wall member of the first vertical partition wall band in an extension direction thereof, and the outermost vertical partition wall member of the first vertical partition wall band is formed in a linear shape.

28. The plasma display panel of claim 17, wherein the second dummy area includes a second horizontal partition wall band formed in a band shape in parallel to one edge of the display region, and a second fan-shaped portion surrounded by a second outer arc-shaped portion and at both ends of the second horizontal partition wall band.

29. The plasma display panel of claim 28, wherein an island partition wall member spaced apart from the first and second dummy areas is separately provided between the first fan-shaped portion of the first dummy area and the second fan-shaped portion of the second dummy area.

30. The plasma display panel of claim 29, wherein the island partition wall member has a circular or ring-shaped section.

31. The plasma display panel of claim 30, wherein the second horizontal partition wall band includes at least one horizontal partition wall member between an outermost horizontal partition wall member and an innermost horizontal partition wall member.

32. The plasma display panel of claim 31, wherein the second fan-shaped portion includes a plurality of second oblique partition wall members linearly extending from a center of a line to the second outer arc-shaped portion, the plurality of second oblique partition wall members connecting a front end of the outermost horizontal partition wall member to a front end of the innermost horizontal partition wall member.

33. The plasma display panel of claim 31, wherein the second outer arc-shaped portion is connected to the outermost horizontal partition wall member of the second horizontal partition wall band in an extension direction thereof, and the outermost horizontal partition wall member of the second horizontal partition wall band is formed in a linear shape.

34. The plasma display panel of claim 31, wherein the second outer arc-shaped portion is connected to the innermost horizontal partition wall member of the second horizontal partition wall band in an extension direction thereof, and the innermost horizontal partition wall member of the second horizontal partition wall band is formed in a linear shape.

35. The plasma display panel of claim 31, wherein the second outer arc-shaped portion has a line width that is gradually widened in a direction from the innermost horizontal partition wall member to the outermost horizontal partition wall member of the second horizontal partition wall band.

36. The plasma display panel of claim 28, wherein the second fan-shaped portion includes a plurality of arc-shaped partition wall members respectively extending from one point of the second horizontal partition wall band to another point thereof.

37. The plasma display panel of claim 36, wherein the second fan-shaped portion includes a plurality of second rib partition wall members linearly extending from the second outer arc-shaped portion to at least one of the plurality of arc-shaped partition wall members and/or between adjacent ones of the plurality of arc-shaped partition wall members.

38. A plasma display panel comprising:

a front substrate and a rear substrate facing each other;

a plurality of address electrodes and a plurality of display electrodes spaced apart from each other and crossing each other between the front substrate and the rear substrate; and a plurality of partition walls forming a display region while partitioning a plurality of discharge cells and forming a non-display region along a periphery of the display region between the front substrate and the rear substrate, wherein the non-display region includes a first dummy area having a plurality of first dummy cells partitioned by a plurality of first dummy partition walls extending from a plurality of partition walls disposed in the display region, and a second dummy area having a plurality of second dummy cells partitioned by a plurality of second dummy partition walls extending from the first dummy area in an extension direction of the plurality of display electrodes, wherein the second dummy area is provided on both sides of the first dummy area in the extension direction of the plurality of display electrodes, and includes a second fan-shaped portion disposed on a corner and surrounded by a vertical line portion and a horizontal line portion intersecting each other and a second outer arc-shaped portion intersecting both the vertical line portion and the horizontal line portion, and a second vertical partition wall band contacting the horizontal line portion of the second fan-shaped portion.

39. The plasma display panel of claim 38, wherein the first dummy area includes:

a first fan-shaped portion disposed outside the display region, and surrounded by a vertical line portion and a horizontal line portion intersecting each other, and a first outer arc-shaped portion intersecting both the vertical line portion of the first fan-shaped portion and the horizontal line portion of the first fan-shaped portion;

a first horizontal partition wall band contacting the vertical line portion of the first fan-shaped portion; and a first vertical partition wall band contacting the horizontal line portion of the first fan-shaped portion.

40. The plasma display panel of claim 39, wherein the first fan-shaped portion includes at least one first oblique partition wall member linearly extending from an intersection of the vertical line portion of the first fan-shaped portion and the horizontal line portion of the first fan-shaped portion to the first outer arc-shaped portion.

41. The plasma display panel of claim 39, wherein the first fan-shaped portion includes a plurality of arc-shaped partition wall members respectively extending from one point of the vertical line portion of the first fan-shaped portion to one point of the horizontal line portion of the first fan-shaped portion.

42. The plasma display panel of claim 41, wherein the first fan-shaped portion includes a plurality of first rib partition wall members linearly extending from the first outer arc-shaped portion to at least one of the plurality of arc-shaped partition wall members and/or between adjacent one of the plurality of arc-shaped partition wall members.

43. The plasma display panel of claim 38, wherein the second dummy area further includes a third vertical partition wall band contacting the vertical line portion of the second fan-shaped portion and the second vertical partition wall band connected thereto and is connected to the first dummy area.

44. The plasma display panel of claim 43, wherein the second outer arc-shaped portion is connected to an outermost horizontal partition wall member of the third vertical partition wall band in an extension direction thereof, and the outermost horizontal partition wall member of the third vertical partition wall band is formed in a linear shape.

45. The plasma display panel of claim 38, wherein the second fan-shaped portion includes at least one second oblique partition wall member linearly extending from an intersection of the vertical line portion of the second fan-shaped portion and the horizontal line portion of the second fan-shaped portion to the second outer arc-shaped portion.

46. The plasma display panel of claim 38, wherein the second fan-shaped portion includes a plurality of arc-shaped partition wall members respectively extending from one point of the vertical line portion of the second fan-shaped portion to one point of the horizontal line portion of the second fan-shaped portion in an arc shape.

47. The plasma display panel of claim 46, wherein the second fan-shaped portion includes a plurality of second rib partition wall members linearly extending from the second arc-shaped portion to at least one of the plurality of arc-shaped partition wall members and/or between adjacent ones of the plurality of arc-shaped partition wall members.

48. The plasma display panel of claim 38, wherein the second outer arc-shaped portion is connected to an outermost vertical partition wall member of the second vertical partition wall band in an extension direction thereof, and the outermost vertical partition wall member of the second vertical partition wall band is formed in a linear shape.

49. The plasma display panel of claim 38, wherein the non-display region further includes a third dummy area having a plurality of third dummy cells partitioned by a plurality of third dummy partition walls spaced apart from the first dummy area at a plurality of intervals.

50. The plasma display panel of claim 49, wherein the third dummy area includes a third horizontal partition wall band formed in a band shape in parallel to one edge of the display region and a third fan-shaped portion at both ends of the third horizontal partition wall band, the third fan-shaped portion being surrounded by a third arc-shaped portion.

* * * * *